US011523640B2

(12) United States Patent
Wallace et al.

(10) Patent No.: US 11,523,640 B2
(45) Date of Patent: Dec. 13, 2022

(54) ATHLETIC BRA

(71) Applicant: adidas AG, Herzogenaurach (DE)

(72) Inventors: Clair Wallace, Portland, OR (US); Emily Jagos, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 16/561,722

(22) Filed: Sep. 5, 2019

(65) Prior Publication Data

US 2021/0068473 A1 Mar. 11, 2021

(51) Int. Cl.
*A41C 3/00* (2006.01)

(52) U.S. Cl.
CPC ..... *A41C 3/0057* (2013.01); *A41C 3/0028* (2013.01)

(58) Field of Classification Search
CPC ..... A41C 3/02; A41C 3/12
See application file for complete search history.

(56) References Cited

U.S. PATENT DOCUMENTS 1,337,224 A * 4/1920 Havens ..... A41C 3/02 450/85
1,362,027 A * 12/1920 Miller ..... A41C 3/00 450/79
1,394,235 A * 10/1921 Tate-Smith ..... A41C 3/00 450/85
1,567,793 A * 12/1925 Ferris ..... A41C 3/08 450/34
1,575,989 A * 3/1926 Haven ..... A41C 3/00 450/58
1,681,119 A * 8/1928 Kennedy ..... A41C 3/00 450/85
1,775,365 A * 9/1930 Fordyce ..... A41C 3/00 450/72
1,886,049 A * 11/1932 Rothblum ..... A41D 7/00 2/67
1,961,048 A * 5/1934 Elfriede ..... A41C 3/0021 450/59
2,067,354 A * 1/1937 Spare ..... A41C 3/0021 450/59
2,104,943 A * 1/1938 Achon ..... A41D 7/00 2/67
2,115,398 A * 4/1938 Rosenthal ..... A41C 3/00 450/62

(Continued)

FOREIGN PATENT DOCUMENTS

CN 103156293 A 6/2013
WO 2018191515 A1 10/2018

*Primary Examiner* — Jocelyn Bravo
(74) *Attorney, Agent, or Firm* — Sterne, Kessler, Goldstein & Fox P.L.L.C.

(57) ABSTRACT

A sports garment includes a cup portion that receives and conforms to a user's breasts, a base portion disposed along a bottom edge of the cup portion, a first strap portion disposed along a first side edge of the base portion, and a second strap portion disposed along a second side edge of the base portion. The first and second strap portions each include a shoulder strap that may be removably coupled to the cup portion to adjust the tension of the sports garment and a side strap that may be removably coupled to a front surface of the base portion to adjust the tension of the sports garment. The first and second side straps may flex between an open position and a wrapped position.

20 Claims, 20 Drawing Sheets

(56) References Cited

U.S. PATENT DOCUMENTS 2,364,899 A * 12/1944 Hatton ..... A41C 3/00 450/28
2,372,855 A * 4/1945 Reid ..... A41C 3/00 450/85
2,402,835 A * 6/1946 Nagy ..... A41C 3/00 450/59
2,468,623 A * 4/1949 Gluckin ..... A41C 3/0021 450/60
2,542,881 A * 2/1951 Ries ..... A41C 3/0078 450/59
2,638,595 A * 5/1953 Goebel ..... A41C 3/00 450/85
2,725,563 A * 12/1955 Rich ..... A41C 3/0021 450/68
2,753,563 A * 7/1956 Blitch ..... A41C 3/0028 450/62
2,800,902 A * 7/1957 Wiltrout ..... A61F 13/143 450/58
3,008,468 A * 11/1961 Williams ..... A41C 3/00 450/2
3,157,182 A * 11/1964 Fridolph ..... A41C 3/00 450/5
3,771,528 A * 11/1973 May ..... A41C 3/00 450/74
4,024,876 A * 5/1977 Penrock ..... A41C 3/148 450/48
4,254,777 A * 3/1981 Johnston ..... A41C 3/142 450/41
4,530,361 A * 7/1985 Wooten ..... A41C 3/0028 450/59
4,681,113 A * 7/1987 Coplans ..... A61F 5/028 2/46
4,781,651 A * 11/1988 Ekins ..... A41C 3/0057 450/25
4,804,351 A * 2/1989 Raml ..... A41C 3/0064 2/DIG. 1
4,816,005 A * 3/1989 Braaten ..... A41C 3/0057 450/58
5,215,494 A * 6/1993 Flanagan ..... A41C 3/0007 2/73
5,221,227 A * 6/1993 Michels ..... A41C 3/0057 2/73
5,411,461 A * 5/1995 Thomascik ..... A63C 3/00 280/1.5
5,643,043 A * 7/1997 Pflum ..... A41C 3/0057 2/73
5,765,224 A * 6/1998 Johnson ..... A41C 1/02 2/44
5,863,236 A * 1/1999 Johnson ..... A41F 1/006 450/62
5,908,346 A * 6/1999 McCall ..... A41F 1/002 450/61
5,951,364 A * 9/1999 Brown ..... A41C 3/02 450/1
5,968,003 A * 10/1999 Sisson ..... A41C 3/0064 602/19
6,023,785 A * 2/2000 Johnson ..... A41C 3/0057 2/62
6,068,538 A * 5/2000 Alleyne ..... A41C 3/0057 450/1
6,168,498 B1 * 1/2001 Wagner ..... A41C 3/0057 450/1
6,200,194 B1 * 3/2001 Grier ..... A41F 1/006 450/1
6,227,936 B1 * 5/2001 Mendoza ..... A41C 3/04 2/104
6,247,996 B1 * 6/2001 Fields ..... A41C 3/04 450/36
6,280,287 B1 * 8/2001 Keith ..... A41C 3/0028 450/1
6,302,761 B1 * 10/2001 Wrenn ..... A41C 3/0057 450/86
6,319,091 B1 * 11/2001 Kilbride ..... A41C 3/0028 450/1
6,422,917 B1 * 7/2002 Rose ..... A41C 3/0014 450/1
6,464,717 B1 * 10/2002 Smith ..... A61F 7/02 450/58
D475,506 S * 6/2003 Hoffman ..... D2/706
D475,835 S * 6/2003 Hoffman ..... D2/706
6,755,717 B2 * 6/2004 Smith ..... A41C 3/0057 128/869
D562,529 S * 2/2008 Tonsor ..... D2/709
7,435,155 B2 * 10/2008 Reinisch ..... A41C 3/0028 450/59
7,909,675 B1 * 3/2011 Rainey ..... A41C 3/148 450/59
7,931,521 B1 * 4/2011 Griffin ..... A41C 3/0028 450/86
8,123,588 B2 * 2/2012 Tyrer ..... A41C 3/12 450/86
8,172,639 B2 * 5/2012 Swendseid ..... A41C 3/0057 450/85
8,267,740 B1 * 9/2012 Afxentiou ..... A41C 3/0021 450/86
8,337,275 B2 * 12/2012 Martins-Crawbuck ..... A41C 3/0028 450/85
8,690,634 B2 * 4/2014 Heath ..... A41C 3/0057 450/41
8,702,471 B2 * 4/2014 Lyman ..... A41D 13/1245 450/54
8,777,692 B2 * 7/2014 Jimenez ..... A41C 3/0007 450/30
8,932,103 B2 * 1/2015 Hansen ..... A41C 3/0028 450/59
8,932,104 B2 * 1/2015 Moylan ..... A41C 3/0057 450/86
9,161,574 B2 * 10/2015 Swendseid ..... A41C 3/0035
9,192,197 B2 * 11/2015 Reinhard ..... A41C 3/02
D750,868 S * 3/2016 Randall ..... D2/707
D764,141 S * 8/2016 Randall ..... D2/708
9,480,287 B2 * 11/2016 Black ..... A41F 15/007
9,681,692 B2 * 6/2017 Hansen ..... A61F 5/03
9,700,081 B2 * 7/2017 Tempesta ..... A41C 3/02
9,918,500 B2 * 3/2018 Tempesta ..... A41C 3/0035
10,136,681 B1 * 11/2018 Malik ..... A41C 3/0035
D851,860 S * 6/2019 Stein ..... D2/706
10,383,373 B2 * 8/2019 Muhlenfeld ..... A41B 1/08
10,905,173 B1 * 2/2021 Kosak ..... A41F 15/02
2001/0019933 A1 * 9/2001 Wagner ..... A41C 3/02 450/37
2006/0048547 A1 * 3/2006 Duckham ..... A41C 3/0014 66/176
2006/0089083 A1 * 4/2006 Tonsor ..... A41C 3/02 450/60
2006/0252346 A1 * 11/2006 Reinisch ..... A41C 3/0028 450/86
2008/0287770 A1 * 11/2008 Kurzweil ..... A61B 5/08 600/388
2009/0098803 A1 * 4/2009 Reinisch ..... A41C 3/0014 450/39
2009/0233522 A1 * 9/2009 Schlatmann ..... A41C 3/0057 450/39
2011/0112453 A1 * 5/2011 Petiot ..... A61F 5/02 602/19
2011/0117818 A1 * 5/2011 Barnard ..... A41C 3/0057 450/58
2011/0177757 A1 * 7/2011 Swendseid ..... A41C 3/0028 450/70
2011/0275278 A1 11/2011 Shashy
2012/0220192 A1 * 8/2012 Swendseid ..... A41C 3/0028 450/85
2013/0065486 A1 * 3/2013 Hansen ..... A41C 3/0064 450/59
2013/0171911 A1 * 7/2013 Swendseid ..... A41C 3/0057 450/85

(56) References Cited

U.S. PATENT DOCUMENTS

| | | | | |
|---|---|---|---|---|
| 2014/0162531 | A1* | 6/2014 | Mazourik | A41C 3/0071<br>450/86 |
| 2015/0099420 | A1* | 4/2015 | Reinhard | A41C 3/02<br>450/58 |
| 2016/0081398 | A1* | 3/2016 | Tempesta | A41C 3/0028<br>450/70 |
| 2016/0309796 | A1* | 10/2016 | DeCotiis | A41C 3/0028 |
| 2017/0143048 | A1* | 5/2017 | Bucciarelli, III | A41C 3/0035 |
| 2017/0273365 | A1* | 9/2017 | Muhlenfeld | A41C 3/12 |
| 2018/0064178 | A1* | 3/2018 | Akerson | A61B 5/4288 |
| 2018/0243549 | A1* | 8/2018 | Hill | A41D 13/1245 |
| 2018/0255839 | A1* | 9/2018 | David | A41C 3/0007 |
| 2020/0260803 | A1* | 8/2020 | Whittaker | A41F 1/002 |
| 2020/0337388 | A1* | 10/2020 | Wilkes | A41C 3/0028 |
| 2020/0345080 | A1* | 11/2020 | Edmark | A41F 1/002 |

* cited by examiner

ATHLETIC BRA

BACKGROUND

Field of the Invention

The present disclosure relates to sports garments, and in particular, a sports bra with adjustable wrap-around straps.

Background Art

Sports garments are typically worn to support and minimize user's breast movement while engaged in a strenuous activity, such as participating in an athletic event.

One typical design for a sports garment is a pre-sized sports bra that includes a non-adjustable elastic rib band having a fixed circumference. However, putting on a pre-sized sports-bra can be cumbersome because one must normally place the sports bra over her head and stretch the rib band around her shoulder to secure the sports bra in place. Moreover, pre-sized sports-bras lack adjustment options for modifying the tension of the sports bra, thereby failing to provide a tailored fit for the user.

Another conventional design for a sports garment is an adjustable sports bra that includes a pair of straps that fasten together along the back of the user. The straps typically include a hook-and-eye closure system, in which one of the straps clips to the other one of straps at about the spinal region of the user. Because the straps meet at the back, the user needs to reach behind her back to readjust the tension and fit of the sports bra. Consequently, one cannot conveniently readjust the fit of the sports bra in the midst of activity, often needing to slow down before attempting to adjust the tension of the straps.

In addition, adjustment sports bras typically include a clunky design, which encumbers the user in the midst of activity.

BRIEF SUMMARY OF THE INVENTION

The present disclosure includes various embodiments of a sports garment for supporting and minimizing breast movement of a user engaged in an athletic activity.

In accordance with one embodiment, a sports garment comprises a cup portion configured to receive and conform to breasts of a user; a base portion disposed along a bottom edge of the cup portion and configured to stretch along a torso of the user to support the cup portion, the base portion comprising a front surface and a back surface; a first strap portion disposed along a first side edge of the base portion, the first strap portion comprising a first side strap configured to be removably fastened to the front surface of the base portion to adjust tension of the sports bra; a second strap portion disposed along a second side edge of the base portion, the second strap portion comprising a second side strap configured to be removably fastened to the front surface of the base portion to adjust tension of the sports bra; and a slot disposed on the sports bra and configured to receive one of the first and second side straps.

In some embodiments, the first and second side straps are configured to flex between an open position and a wrapped position. In some embodiments, when the first and second side straps are set in the wrapped position, one of the first and second side straps is received through the slot such that first and second strap portions continuously overlap each other along the back surface of the base portion to wrap around a back of a user. In some embodiments, when the first and second side straps are set in the open position, the first and second strap portions do not overlap each other along the back surface of the base such that the back surface of the base portion is exposed to receive the torso of the user.

In some embodiments, the base portion comprises a first fastening section disposed on the front surface of the base portion and a second fastening section disposed on the front surface of the base portion and spatially separated from the first fastening section. In some embodiments, the first strap portion comprises a first fastening member disposed on the first side strap and configured to be removably fastened to the second fastening section of the base portion, and the second strap portion comprises a second fastening member disposed on the second side strap and configured to be removably fastened to the first fastening section of the base.

In some embodiments, the first and second fastening members and the first and second fastening sections are hook-and-loop fasteners. In some embodiments, the slot is disposed on the base and between: (i) the first fastening section and the first side edge or (ii) the second fastening section and the second side edge. In some embodiments, the first strap portion comprises a first shoulder strap, and the second strap portion comprises a second shoulder strap; and the first and second shoulder straps are configured to hang over shoulders of the user and be removably coupled to the cup portion to adjust tension of the sports bra. In some embodiments, the cup portion, the base portion, the first strap portion, and the second strap portion each comprise a frontal seamless layer comprised of an elastic material. In some embodiments, the cup portion comprises a first interior layer comprised of a mesh material and a second interior layer comprised of a rigid material.

In some embodiments, the first strap portion comprises a first back panel extending from the first side edge of the base portion, and the first side and shoulder straps merge at the first back panel. In some embodiments, the second strap portion comprises a second back panel extending from the second side edge of the base portion, and the second side and shoulder straps merge at the second back panel.

In accordance with one embodiment, a sports garment comprises a cup portion configured to receive and conform to breasts of a user; a base portion disposed along a bottom edge of the cup portion and configured to stretch along a torso of the user to support the cup portion, the base portion comprising a front surface, a back surface, a first fastening section disposed on the front surface of the base portion, and a second fastening section disposed on the front surface of the base portion and spatially separated from the first fastening section; a first strap portion disposed along the first side edge of the base portion, the first strap portion comprising a first shoulder strap, a first side strap, and a first fastening member disposed on the first side strap and configured to be removably fastened to the second fastening section to adjust tension of the sports garment; and a second strap portion disposed along a second side edge of the base portion, the second strap portion comprising a second shoulder strap, a second side strap, and a second fastening member disposed on the second side strap and configured to be removably fastened to the first fastening section to adjust tension of the sports garment, In some embodiments, the first and second side straps are configured to flex between an open position and a wrapped position. In some embodiments, when the first and second side straps are set in the wrapped position, the first fastening member is fastened to the second fastening section of the base portion and the second fastening member is fastened to the first fastening section of the base portion such that the first and second strap portions extend across a length of the back surface of the base portion to wrap around a back of the user. In some embodiments, when the first and second side straps are set in the open position, the first and second strap portions do not extend across the back surface of the base portion such that the back surface of the base portion is exposed to receive the torso of the user. In some embodiments, the first and second shoulder straps are configured to hang over shoulders of the user and be removably coupled to the cup portion to adjust tension of the sports garment.

In accordance with one embodiment, a sports garment comprises a cup portion configured to receive and conform to breasts of a user; a base portion disposed along a bottom edge of the cup portion and configured to stretch along a torso of the user to support the cup portion, the base portion comprising a front surface and a back surface; a first strap portion disposed along the first side edge of the base portion, the first strap portion comprising a first shoulder strap and a first side strap configured to be removably fastened to the front surface of the base portion to adjust tension of the sports bra; and a second strap portion disposed along a second side edge of the base portion, the second strap portion comprising a second shoulder strap and a second side strap configured to be removably fastened to the front surface of the base portion to adjust tension of the sports bra.

In some embodiments, the first and second shoulder straps are configured to hang over the shoulders and be removably coupled to the cup portion to adjust tension of the sports garment. In some embodiments, the first and second side straps are configured to flex between an open position and a wrapped position. In some embodiments, when the first and second side straps are set in the wrapped position, the first and second side straps are fastened to the front surface of the base portion such that the first and second strap portions extend across the back surface of the base portion to wrap around a back of the user. In some embodiments, when the first and second side straps are set in the open position, the first and second strap portions do not extend across the back surface of the base portion such that the back surface of the base portion is exposed to receive the torso of the user. In some embodiments, the cup portion, the base portion, the first strap portion, and the second strap portion each comprise a seamless frontal layer comprised of an elastic material.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION OF THE INVENTION

Figure 1:
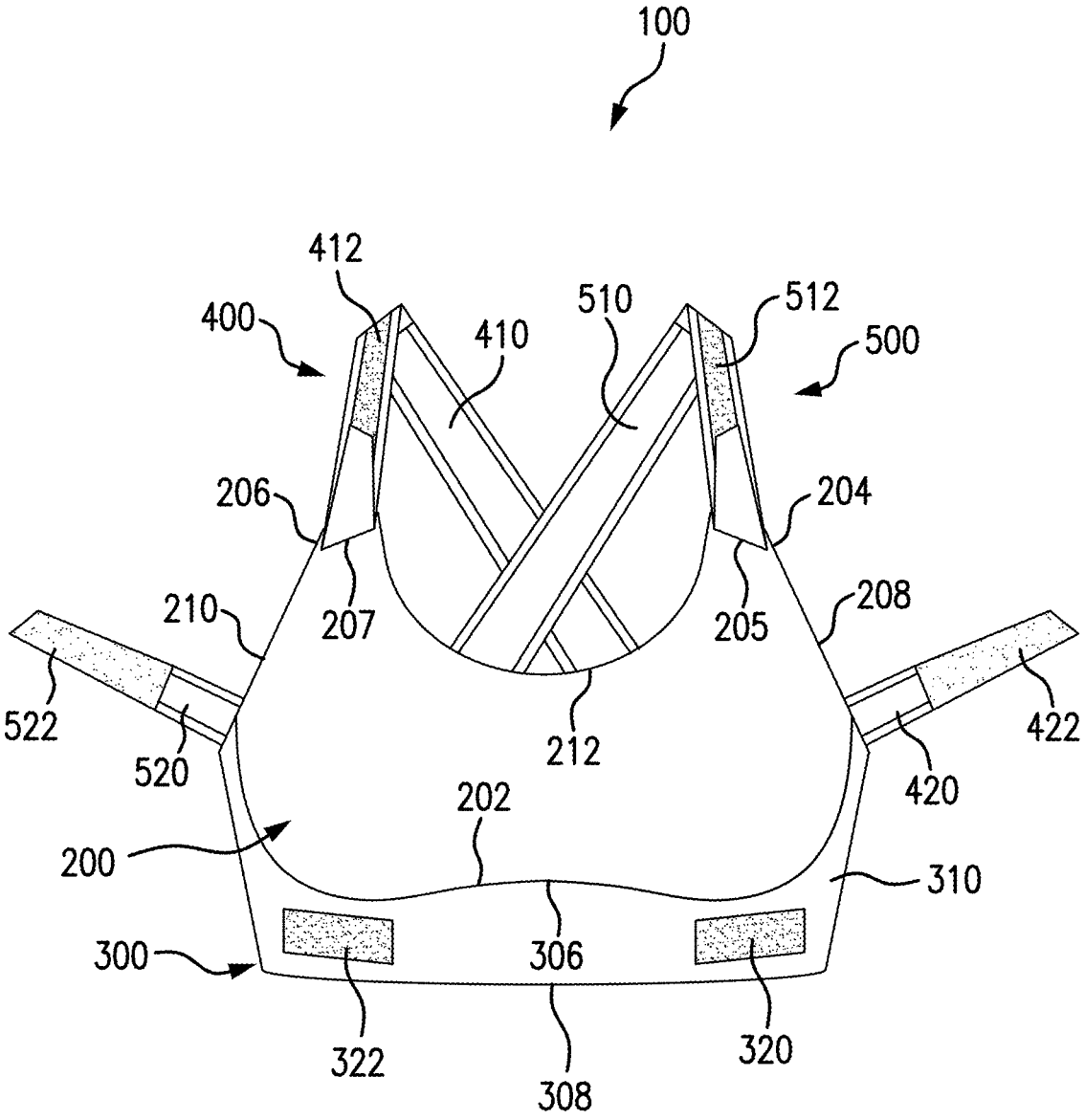
FIG. 1 shows a front view of a sports garment comprising first and second side straps set in an open position according to embodiments.

The present inventions will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present inventions. Other suitable modifications and adaptations of the variety of conditions and parameters normally encountered in the field, and which would be apparent to those skilled in the art, are within the spirit and scope of the inventions.

While various designs for sports garments (e.g., sports bras) are known, conventional sports garment designs have many flaws, such as failing to provide proper support for the user's breasts, lacking convenient adjustment features, or simply being cumbersome to put on or take off.

For example, pre-sized sports bras with a non-adjustable elastic rib band having a fixed circumference usually require the process of placing the sport's bra over the user's head and stretching the rib band around the user's shoulder for the sports bra to be worn by the user. Moreover, pre-sized sports bras typically include a single molded cup, which fails to provide adequate support for the user's breast.

Another example includes the adjustable sports bra with a pair of straps that clasp together at about the spinal region of the user. Once secured to the user, these types of sports bras are difficult to readjust along the user's torso because the user must reach behind her back to adjust the tension of the straps. Thus, one usually must pause from her activity to adjust the fit of the sports bra.

While other sport bras have adjustment features on the front side of the sports bra, these types of bras typically require connecting multiple pieces, such as straps, clips, and panels, together, rendering the sports bra clunky. The clunky design encumbers the user during athletic activity, ultimately slowing the user down and being uncomfortable.

Accordingly, there is a need for a sports bra that may be secured to the user with little effort, and at the same time, still provide high support for the user. Moreover, there is a need for a sports bra that allows the user to easily adjust the fit and tension of sports bra after being placed on the user, while still providing a sleek design that does not encumber the user in the midst of strenuous activity.

According to various embodiments described herein, the sports garment of the present disclosure may overcome one or more of the deficiencies noted above by comprising a cup portion configured to receive and conform to the user's breast, a base portion disposed below the cup portion and configured to stretch along the user's torso to support the cup portion, a first strap portion disposed along a first side edge of the base portion, and a second strap portion disposed along a second side of the base portion. The first and second strap portions are configured to flex away from a torso of a user and wrap around the torso of the user so that the user may don or remove the sports garment without pulling the sports garment around the user's head and shoulders. The cup portion, base portion, first strap portion, and second strap portion are integrated as a single piece sports bra comprising a streamlined contour that does not encumber the user in the midst of activity, ultimately promoting more comfort to the user. The first and second strap portions are configured to be removably coupled to a front surface of the base portion so that the user may adjust the tension and fit of the sports garment without reaching behind the user's back.

FIGS. 1-6 illustrate a sports garment 100 for supporting and minimizing breast movement of a user engaged in an athletic activity according to one embodiment of the present disclosure. Sports garment 100 may include a cup portion 200, a base portion 300, a first strap portion 400, and a second strap portion 500 that are integrated together to form a single piece sports bra configured to wrap around a torso of the user and flap apart toward an open configuration such that the user may don or remove sports garment 100 without pulling sports garment 100 around the user's head and shoulders.

Figure 2:
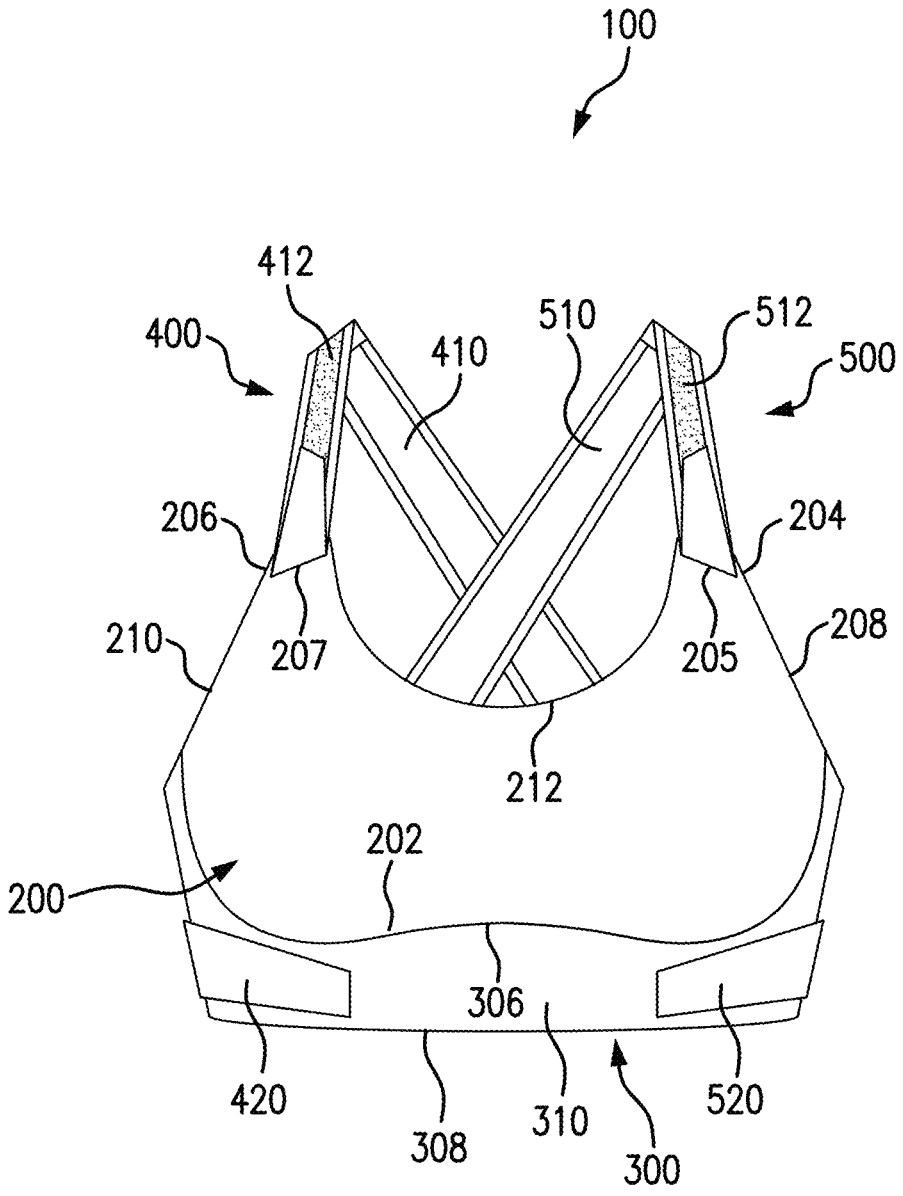
FIG. 2 shows a front view of a sports garment comprising first and second side straps set in a wrapped position according to embodiments.

In various embodiments, cup portion 200 is shaped to receive and cover breasts of the user. In one embodiment, as shown in FIGS. 1 and 2, for example, cup portion 200 extends in a vertical direction along a chest of the user from a bottom edge 202 to a first shoulder edge 204 and a second shoulder edge 206. Cup portion 200 extends in a lateral direction along a chest of the user from a first arm edge 208 to a second arm edge 210, in which first arm edge 208 extends from bottom edge 202 to first shoulder edge 204 and second arm edge 210 extends from bottom edge 202 to second shoulder edge 206. Cup portion 200 includes a neckline edge 212 extending in the lateral direction from first shoulder edge 204 to second shoulder edge 206 and curving towards bottom edge 202. In some embodiments, cup portion 200 may have fewer or more edges, so long as cup portion 200 is configured to receive and cover breasts of the user.

Figure 6:
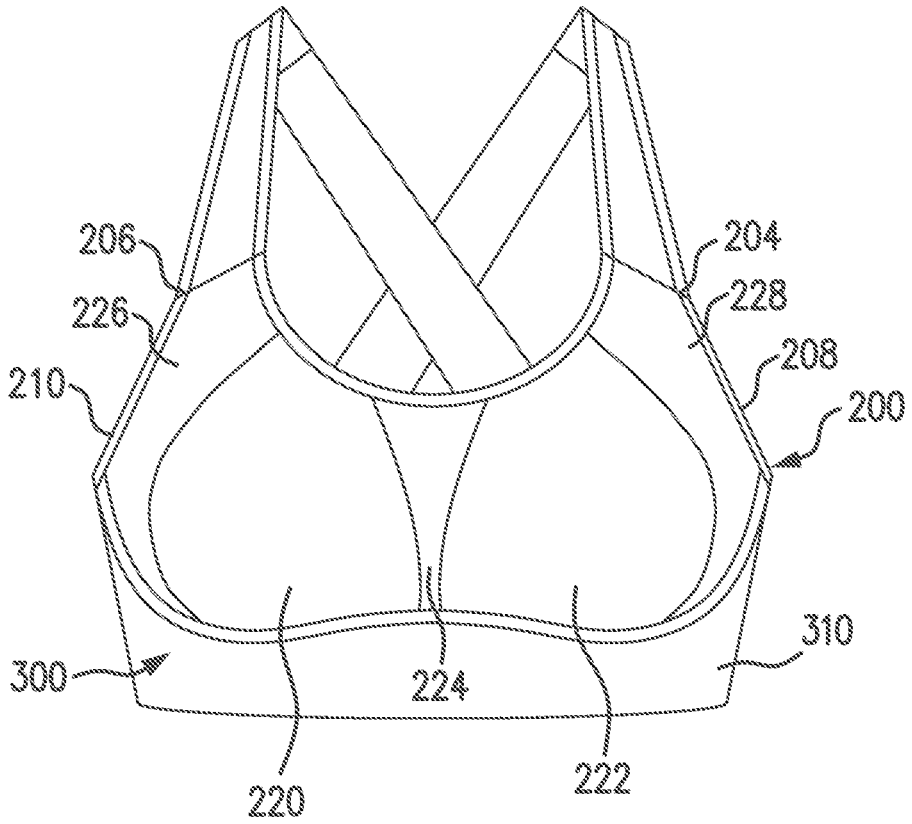
FIG. 6 shows a front view of a sports garment with frontal layer removed according to embodiments.

In various embodiments, cup portion 200 includes a plurality of sections defining different shapes and comprising various layers of material so that the cup portion 200 may conform and support breasts of the user. Referring to FIG. 6, for example, in one embodiment, cup portion 200 includes a first cup section 220 and a second cup section 222 each comprising a cup mold protruding away from the chest of the user for receiving a breast of the user. First cup section 220 and second cup section 222 each comprise a sufficient amount of elasticity to conform to breasts of the user. Cup portion includes a center section 224 disposed between first cup section 220 and second cup section 222 and configured to press against a sternum of the user. Cup portion 200 includes a first side section 226 adjacent to first arm edge 208 and extending from first shoulder edge 204 to bottom edge 202. Cup portion 200 includes a second side section 228 adjacent to second arm edge 210 and extending from second shoulder edge 206 to bottom edge 202. Center section 224, first side section 226, and second side section 228 each comprise a sufficient amount of rigidity to cradle the more elastic first cup section 220 and second cup section 222. In some embodiments, cup portion 200 may have fewer or more sections, so long as cup portion 200 is configured to receive and conform to breasts of the user.

Figure 9:
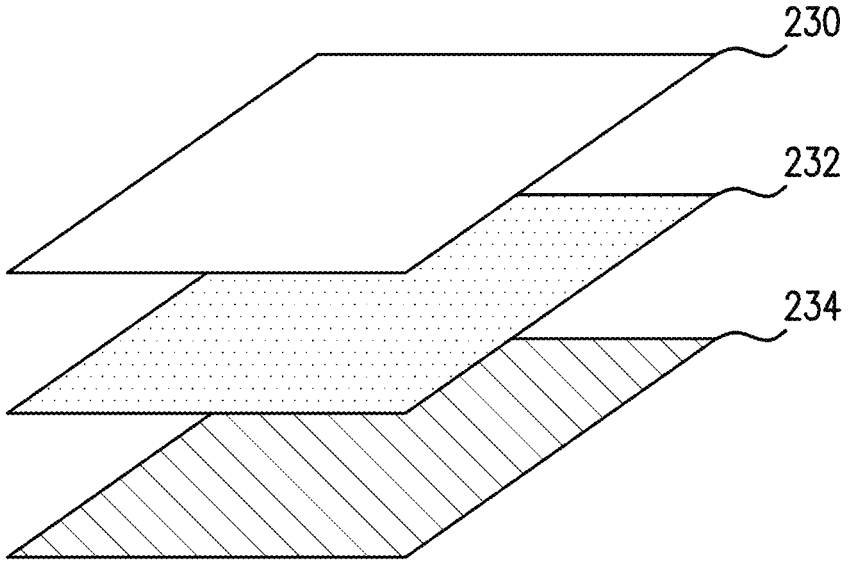
FIG. 9 shows an exploded view of some of the layers of different materials used for constructing a cup portion of a sports garment according to embodiments.

In various embodiments, cup portion 200 may include at least two layers comprised of different materials so that cup portion 200 provides suitable compressibility and support against breasts of the user. FIG. 9 illustrates an exploded view of some of the layers of different materials used for constructing cup portion 200 according to one embodiment of the present disclosure.

As shown in FIG. 9, for example, cup portion 200 includes a seamless frontal layer 230 extending continuously between all sides of cup portion 200 without any gaps or interruptions. In various embodiments, frontal layer 230 may be a woven, non-woven, or knitted polymeric layer. In various embodiments, frontal layer 230 is comprised of an elastomer material so that front layer 230 may stretch and conform to the shape of breasts of the user. In some embodiments, front layer 230 comprises a polymeric material, such as polyamide, elastane, polyester, polyethylene (PE), and co-polymers or polymer blends including one or more these polymers. In embodiments, frontal layer 230 comprises a blend of polyamide in a range between 20-95% and elastane in a range between 5-95%.

In various embodiments, cup portion 200 may include one or more interior layers disposed on a back surface of frontal layer 230. In one embodiment, as shown for example in FIG. 9, one or more interior layers of cup portion 200 includes a first interior layer 232 comprising a first surface disposed against back surface of frontal layer 230 and configured to define the cup mold of first cup section 220 and second cup section 220. In various embodiments, first interior layer 232 may be a woven, non-woven, or knitted polymeric layer. In various embodiments, first interior layer 232 is comprised of polymeric material, such as thermoplastic polyurethane (TPU), polyester, polyamide, polyethylene (PE), PE foam, polyurethane (PU) foam, elastane, co-polymers or polymer blends including one or more these polymers. In one embodiment, first interior layer 232 comprises a blend of polyester in a arrange. In various embodiments, as shown in FIG. 6, for example, first interior layer 232 covers the entire first cup section 220 and second cup section 222. In some embodiments, first interior layer 232 extends continuously between all sides of cup portion 200.

In some embodiments, as shown in FIG. 9, for example, cup portion 200 may include a second interior layer 234 comprising a front surface disposed against a back surface of first interior layer 232 or frontal layer 230. Second interior layer 234 is disposed in center section 224, first side section 226, and second side section 228 and displaced from first cup section 220 and second cup section 222, such that first interior layer 232 is exposed along first cup section 220 and second cup section. In various embodiments, second interior layer 234 may be a woven, non-woven, or knitted polymeric layer. In various embodiments, second interior layer 234 comprises a rigid material so that second interior layer 234 may cradle first cup section 220 and second cup section 222. In some embodiments, second interior layer comprises a laminated polymeric material.

Figure 3:
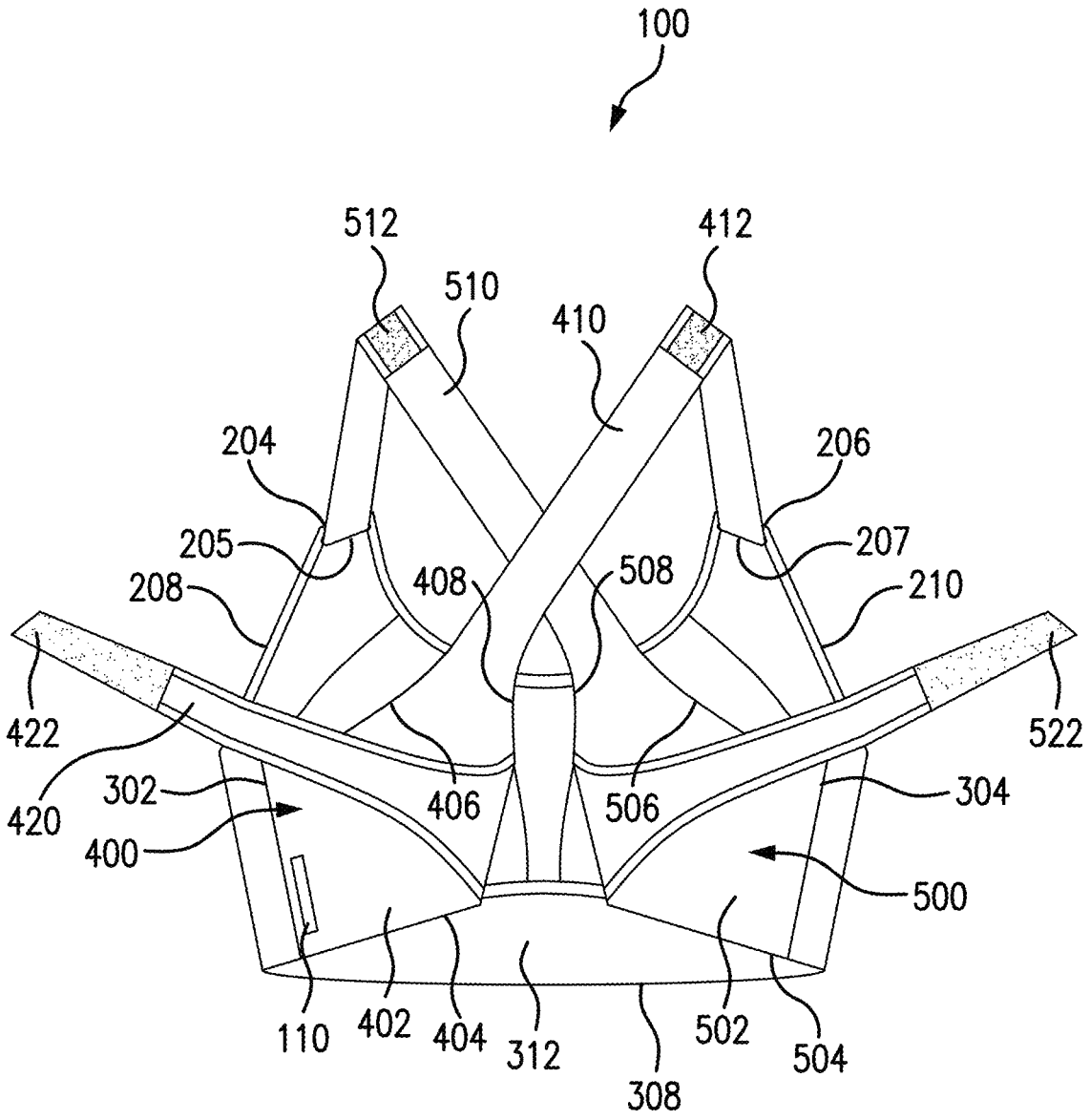
FIG. 3 shows a back view of a sports garment comprising first and second side straps set in an open position according to embodiments.

In various embodiments, base portion 300 is disposed along bottom edge 202 of cup portion 200 and configured to stretch along a torso of the user to support cup portion 200. In some embodiments, as shown in FIG. 3, for example, base portion 300 is band-shaped and extends in a lateral direction along torso of the user between a first side edge 302 and a second side edge 304. In some embodiments, as shown in FIGS. 1 and 2, for example, base portion 300 includes an upper edge 306 that extends contiguously along bottom edge 202 of cup portion 200, where the base portion 300 and cup portion 200 are joined together. In some embodiments, upper edge 306 of base portion 300 is joined with bottom edge 202 of cup portion 200 by any suitable process, such as adhesive bonding, knitting, stitching, sowing, threading, weaving, or a combination thereof. In some embodiments, a piece of elastic trim may be sewn or bonded to the intersection between upper edge 306 of base portion 300 and bottom edge 202 of cup portion 200. Base portion 300 terminates at a bottom edge 308 extending from first side edge 302 to second side edge 304. The length of base portion 300 is limited in the lateral direction such that the base portion 300 is not configured to circumvent the entire torso of the user. When sports garment 100 is worn by the user, first side edge 302 and second side edge 304 are configured to terminate along sides or latissimus muscle of the user.

In various embodiments, as shown for example in FIG. 1, base portion 300 may include a first fastening section 320 disposed on a front surface 310 of base portion 300 and a second fastening section 322 disposed on front surface 310 of base portion 300, where the first fastening section 320 is spatially separated from second fastening section 322 along the length of the base portion 300. In the illustrate embodiment, first fastening section 320 is disposed proximate to first side edge 302 of base portion 300, and second fastening section 322 is disposed proximate to second side edge 304 of base portion 300. In some embodiments, first fastening section 320 and second fastening section 322 are equally spaced apart from first and second side edges 302, 304 by a predetermined distance (for example, based on the size of the garment). In some embodiments, as shown in FIG. 1, for example, first fastening section 320 and second fastening section 322 are hook straps of a hook-and-loop fastener. However, in some embodiments, first fastening section 320 and second fastening section 322 may include any other suitable fastener, such as a series of holes to receive a hook, loops to catch a button, clips to connect with a corresponding clip, or a combination thereof. In embodiments, a single fastening section may be used, and may extend along base portion 300 from proximate to first side edge 302 to proximate second side edge 304.

Figure 10:
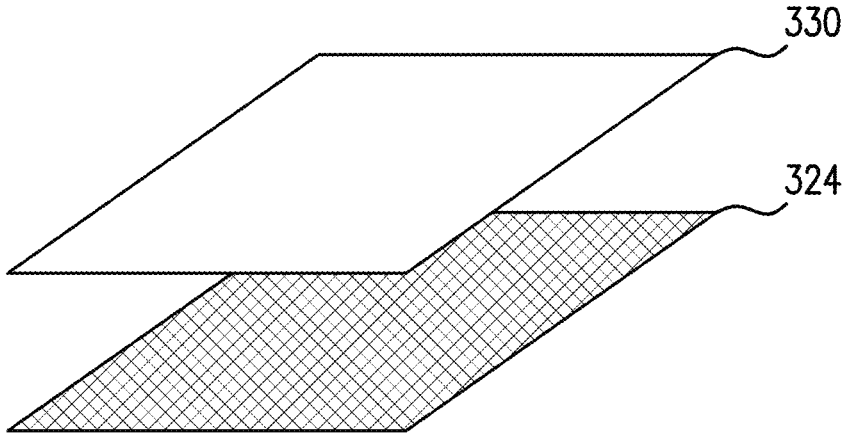
FIG. 10 shows an exploded view of some of the layers of different materials used for constructing a base portion of a sports garment according to embodiments.

FIG. 10 illustrates an exploded view of some of the layers of materials used for constructing base portion 300 according to one embodiment of the present disclosure. In various embodiments, as shown in FIG. 10, for example, base portion 300 includes a seamless frontal layer 330 extending continuously between all sides of base portion 300 without any gaps or interruptions. In various embodiments, frontal layer 330 may be a woven, non-woven, or knitted polymeric layer. In various embodiments, frontal layer 330 is comprised of an elastomer material so that frontal layer 330 may stretch and conform to the contour of the user's torso. In some embodiments, frontal layer 230 comprises a polymeric material, such as polyamide, elastane, polyester, polyethylene (PE), and co-polymers or polymer blends including one or more these polymers. In some embodiments, frontal layer 330 comprises a blend of polyamide in a range between 20-95% and elastane in a range between 5-80%. In some embodiments, frontal layer 330 of base portion 300 comprises the same material or polymeric layer as frontal layer 230 of cup portion 200.

In various embodiments, base portion 300 may include one or more interior layers disposed flushed against a back surface frontal layer 330 and joined together by any suitable process, such as adhesive bonding, knitting, stitching, sowing, threading, weaving, or a combination thereof. The one or more interior layers of base portion 300 may be comprised of an elastomer material. In some embodiments, the one or more interior layers of base portion 300 comprises a polymeric material, such as polyamide, elastane, polyester, polyethylene (PE), and co-polymers or polymer blends including one or more these polymers. In some embodiments, the one or more interior layers of base portion 300 is comprised of the same material as frontal layer 330 of base portion 300.

In some embodiments, as shown in FIG. 10, for example, first fastening section 320 and second fastening section 322 may be comprised of a synthetic fabric strap 324 disposed against frontal surface of frontal layer 330. Fabric strip 324 comprises a plurality of macro-sized hooks configured to fasten to a corresponding loop strap of a hook-and-loop fastener.

Figure 4:
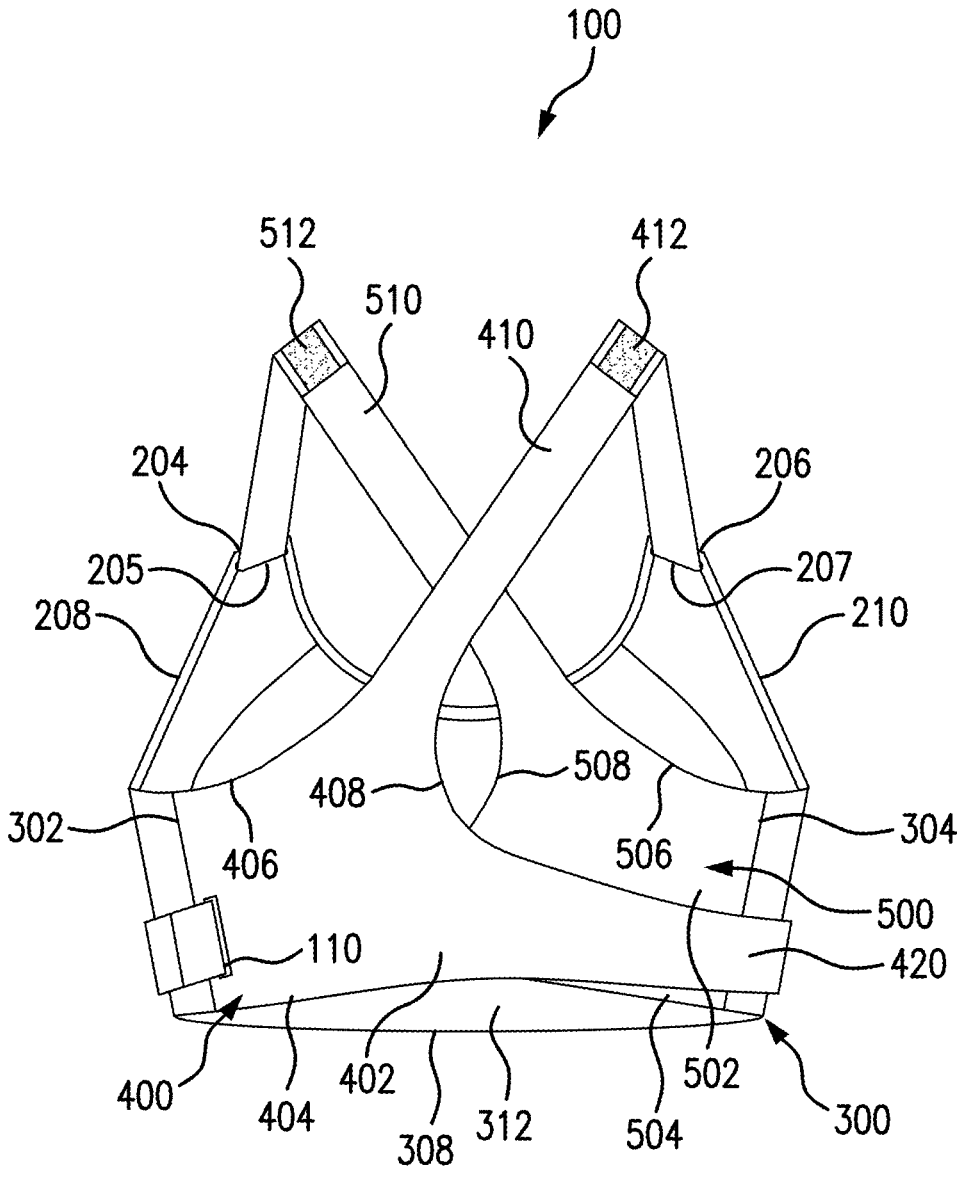
FIG. 4 shows a back view of a sports garment comprising first and second side straps set in a wrapped position according to embodiments.

Referring to FIGS. 3 and 4, in various embodiments, first strap portion 400 is disposed along first side edge 302 of base portion 300, and second strap portion 500 disposed along second side edge 304 of base portion 300. As shown in FIG. 3, for example, first strap portion 400 and second strap portion 500 are each configured to pivot or flex away from a back surface 312 of base portion 300 toward an open configuration so that the user may put on or remove sports garment 100 without pulling sports garment 100 over her head. As shown in FIG. 4, for example first strap portion 400 and second strap portion 500 are each configured to pivot or flex toward a back surface 312 of base portion 300 toward a wrapped configuration such that first strap portion 400 and second strap portion 500 wrap around the back of the user to adjust the fit and tension of sports garment 100.

In various embodiments, first strap portion 400 includes a first back panel 402 that extends contiguously along first side edge 302 of base portion 300, where the base portion 300 and cup portion 200 are joined together. In some embodiments, first side edge 302 of base portion 300 is joined with first back panel 402 of first strap portion 400 by any suitable process, such as adhesive bonding, knitting, stitching, sowing, threading, weaving, or a combination thereof. In some embodiments, first back panel 402 extends in a vertical direction from a bottom edge 404 to an upper edge 406 and terminates at an intersection edge 408 in a lateral direction away from first side edge 302. First back panel 402 is configured to pivot about first side edge 302 of base portion 300 in a direction toward or away from back surface 312 of base portion 300. When pivoted toward back surface 312 of base portion 300, first back panel 402 is configured to cover substantially half of back surface 312 of base portion 300 and at least a portion of first cup section 220 of cup portion 200.

In various embodiments, first strap portion 400 includes a first shoulder strap 410 extending away from first back panel 402 in a first direction and a first side strap 420 extending away from first back panel 402 in a second direction, where first shoulder strap 410 and first side strap 420 merge at about intersection edge 408 of first back panel 402. First shoulder strap 410 and first side strap 420 each extend continuously from first back panel 402 without any gaps or seams such that first strap portion 400 comprises a streamlined contour. In some embodiments, first shoulder strap 410 includes a width in a range between 1-8 cm, and first side strap 420 includes a width in a range between 1-8 cm. In one embodiment, first shoulder strap 510 includes a width of 3.5 cm, and first side strap 420 includes a width of 2.5 cm.

In various embodiments, second strap portion 500 includes a second back panel 502 that extends contiguously along second side edge 304 of base portion 300, where the base portion 300 and cup portion 200 are joined together. In some embodiments, second side edge 304 of base portion 300 is joined with second back panel 502 of second strap portion 500 by any suitable process, such as adhesive bonding, knitting, stitching, sowing, threading, weaving, or a combination thereof. In some embodiments, second back panel 502 extends in a vertical direction from a bottom edge 504 to an upper edge 506 and terminates at an intersection edge 508 in a lateral direction away from second side edge 304. Second back panel 502 is configured to pivot about second side edge 304 of base portion 300 in a direction toward or away from back surface 312 of base portion 300. When pivoted toward back surface 312 of base portion 300, second back panel 502 is configured to cover substantially half of back surface 312 of base portion 300 and at least a portion of second cup section 222 of cup portion 200.

In various embodiments, second strap portion 500 includes a first shoulder strap 510 extending away from second back panel 502 in a third direction and a second side strap 520 extending away from second back panel 502 in a fourth direction, where second shoulder strap 510 and second side strap 520 merge at about intersection edge 508 of second back panel 502. Second shoulder strap 510 and second side strap 520 each extend continuously from second back panel 502 without any gaps or seams such that second strap portion 500 comprises a streamlined contour. In some embodiments, second shoulder strap 510 includes a width in a range between 1-8 cm, and second side strap 520 includes a width in a range between 1-8 cm. In one embodiment, second shoulder strap 510 includes a width of 3.5 cm, and second side strap 520 includes a width of 2.5 cm.

In various embodiments, as shown in FIGS. 1-4, for example, first shoulder strap 410 and second shoulder strap 510 are configured to intersect each other along the back of the user and hang over a shoulder of the user. First shoulder strap 410 and second shoulder strap 510 each include a fastener 412, 512 such that the first shoulder strap 410 and second shoulder strap 510 may be removably coupled to cup portion 200. Fasteners 412, 512 are each configured to allow the length of first shoulder strap 410 and 510 to be modified to adjust the tension and fit of sports garment 100.

In some embodiments, first shoulder strap 410 is configured to pass through a slot 207 disposed on cup portion 200 proximate to second shoulder edge 206, and second shoulder strap 510 is configured to pass through a slot 205 disposed on cup portion 200 proximate to first shoulder edge 204. In some embodiments, fasteners 412, 512 are each a hook-and-loop fastener comprising a hook strap disposed proximate to a distal end 411, 511 of first and second shoulder straps 410, 510 and a loop strap disposed adjacent to the hook strap. However, in some embodiments, fasteners 412, 512 may include any other suitable fastener, such as a series of holes to receive a hook, loops to catch a button, clips to connect with a corresponding clip, or a combination thereof. In some embodiments, fasteners 412, 512 may comprise hook-and-loop fasteners disposed along an exterior surface of first and second shoulder straps 410, 510. In some embodiments, fasteners 412, 512 may comprise hook-and-loop fasteners disposed along an interior surface of first and second shoulder straps 410, 510.

Figure 7:
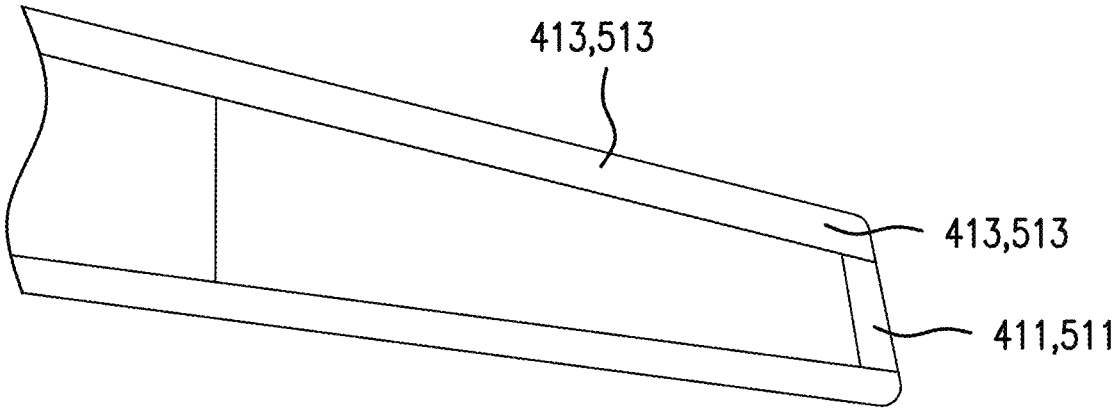
FIG. 7 shows a detailed view of a hemmed tab disposed on a distal end of a shoulder strap according to embodiments.

In some embodiments, as shown in FIG. 7, for example, first shoulder strap 410 may include a hemmed tab 413 disposed at distal end 411 of first side strap 420 to secure fastener 412 to first shoulder strap 410, and second shoulder strap 510 may include a hemmed tab 513 disposed at distal end 511 of second side strap 520 to secure second fastening member 522 to second side strap 520. In various embodiments, hemmed tabs 413, 513 each extend contiguously from the distal end 411, 511 of their respective shoulder strap 410, 510 such that hemmed tabs 413, 513 and first and second shoulder straps 410, 510 form a streamlined contour.

In various embodiments, as shown in FIGS. 1-4, for example, first side strap 420 includes a first fastening member 422 configured to be removably coupled to second fastening section 322 of base portion 300 to adjust tension and fit of sports garment 100, and second side strap 520 includes a second fastening member 522 configured to be removably coupled to first fastening section 320 of base portion 300 to adjust tension and fit of sports garment 100. In embodiments, first fastening member 422 and second fastening member 522 are each a loop strip of the hook-and-loop fastener. However, in other embodiments, first fastening member 422 and second fastening member 522 may include any other suitable fastener, such as a series of holes to receive a hook, loops to catch a button, clips to connect with a corresponding clip, or a combination thereof.

Figure 8:
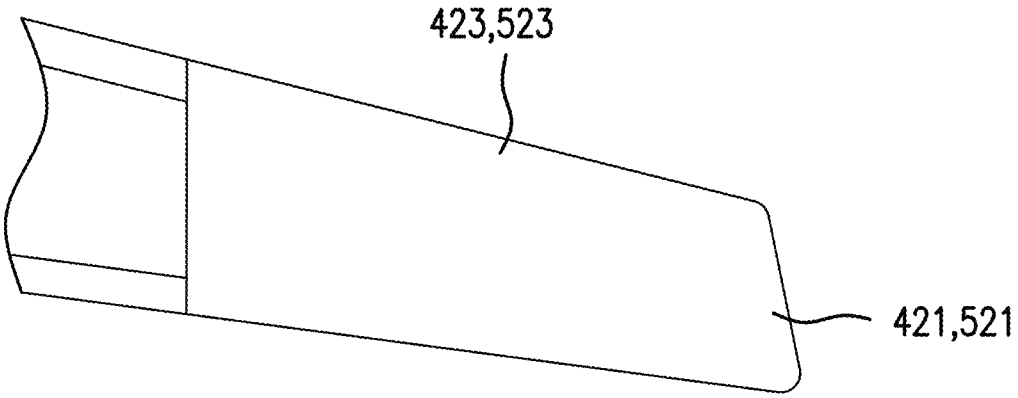
FIG. 8 shows a detailed view of a hemmed tab disposed on a distal end of a side strap according to embodiments.

In some embodiments, as shown in FIG. 8, for example, first side strap 420 may include a hemmed tab 423 disposed at a distal end 421 of first side strap 420 to secure first fastening member 422 to first side strap 420, and second side strap 520 may include a hemmed tab 523 disposed at a distal end 521 of second side strap 520 to secure second fastening member 522 to second side strap 520. In various embodiments, hemmed tabs 423, 523 each extend contiguously from the distal end 421, 521 of their respective side strap 420, 520 such that hemmed tabs 423, 523 and first and second side straps 420, 520 form a streamlined contour.

Referring to FIGS. 3 and 4, first side strap 420 and second side strap 520 are each configured to flex between an open position (e.g., FIG. 3) and a wrapped position (e.g., FIG. 4). When first side strap 420 and second side strap 520 are set at the open position, a distal end 421 of first side strap 420 is moved away from second side edge 304 of base portion 300, and a distal end 521 of second side strap 520 is moved away from first side edge 302 of base portion 300. When first side strap 420 is set at the wrapped position, distal end 421 of first side strap 420 is pulled across second side edge 304 of base portion 300, and first fastening member 422 is fastened to second fastening section 322 of base portion 300. When second side strap 520 is set at the wrapped position, distal end 521 of second side strap 520 is pulled across first side edge 302 of base portion 300, and second fastening member 522 is fastened to first fastening section 320 of base portion 300.

Figure 11:
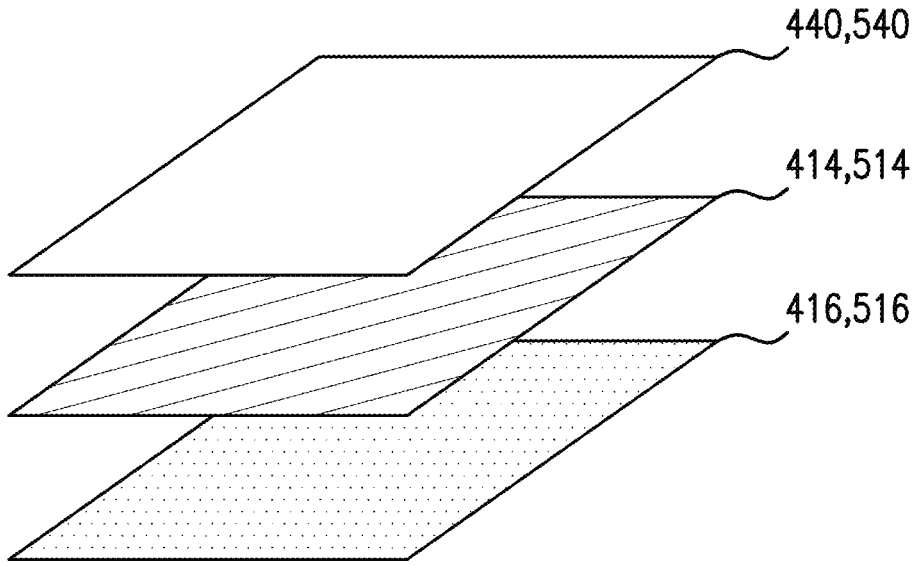
FIG. 11 shows an exploded view of some of the layers of different materials used for constructing a shoulder strap of a sports garment according to embodiments.
Figure 12:
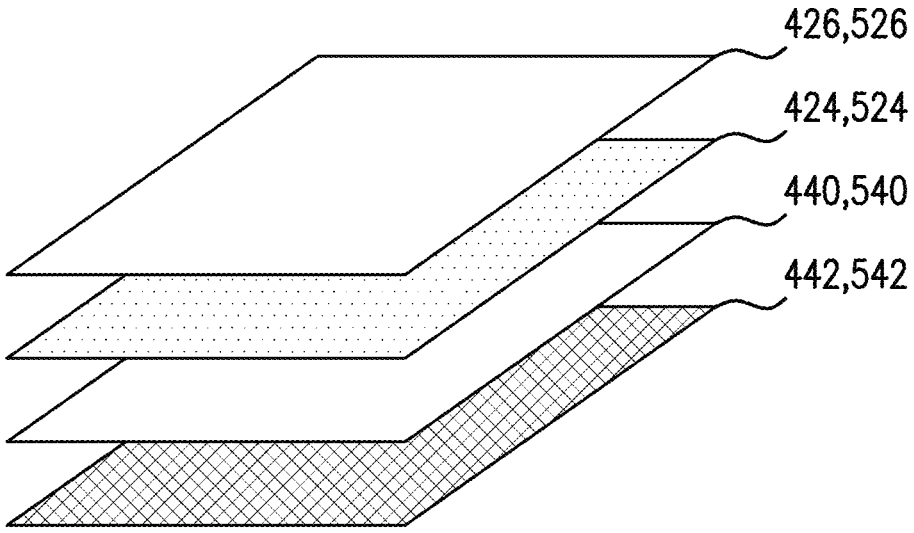
FIG. 12 shows an exploded view of some of the layers of different materials used for constructing a side strap of a sports garment according to embodiments.

FIG. 11 illustrates an exploded view of some of the layers of different materials used for constructing first and second shoulder straps 410, 510 according to one embodiment of the present disclosure. FIG. 12 illustrates an exploded view of some of the layers of different materials used for constructing first and second side straps 420, 520 according to one embodiment of the present disclosure.

As shown FIGS. 11 and 12, for example, first strap portion 400 includes a seamless frontal layer 440 extending continuously between all edges of first strap portion 400, including the first shoulder strap 410 and first side strap 420, without any gaps or interruptions, and second strap portion 500 includes a seamless frontal layer 540 extending continuously between all edges of second strap portion 500, including the first shoulder strap 410 and the second side strap 420, without any gaps or interruptions. In various embodiments, frontal layers 440, 540 may each be a woven, non-woven, or knitted polymeric layer. In various embodiments, frontal layers 440, 540 are each comprised of an elastomer material so that frontal layers 440, 540 may stretch and conform to the contour of the user's torso. In some embodiments, frontal layers 440, 540 each comprise a polymeric material, such as polyamide, elastane, polyester, polyethylene (PE), and co-polymers or polymer blends including one or more these polymers. In some embodiments, frontal layers 440, 540 each comprise a blend of polyamide in a range between 20-95% and elastane in a range between 5-80%.

In various embodiments, frontal layers 440, 540 of first and second strap portions 400, 500 comprise the same materials as frontal layers 230, 330 of cup portion 200 and base portion 300. In various embodiments, frontal layers 440, 540 of first and second strap portions 400, 500 each extend contiguously with frontal layer 330 of base portion 300. Accordingly, frontal layers 230, 330, 440, and 540 of each portion of sports garment 100 extend contiguously with each other such that sports garment 100 may be formed as a single piece sports bra comprising a streamlined contour.

As shown in FIG. 11, for example, first shoulder strap 410 and second shoulder strap 510 may each include one or more interior layers disposed on a back surface of their respective frontal layer 440, 540. In one embodiment, one or more interior layers of first shoulder strap 410 may include a first interior layer 414 and a second interior layer 416, and one or more interior layers of second shoulder strap 510 may include a first interior layer 514 and a second interior layer 516. In various embodiments, first interior layers 414, 514 each comprise a first surface disposed against back surface of their respective frontal layer 440, 540. In various embodiments, second interior layers 416, 516 each comprise a front surface disposed against a back surface of their respective first interior layer 414, 514.

In various embodiments, first interior layers 414,514 and second interior layers 416, 516 may each be a woven, non-woven, or knitted polymeric layer. In various embodiments, first interior layers 414, 514 and second interior layers 416, 516 are each comprised of polymeric material, such as thermoplastic polyurethane (TPU), polyester, polyamide, polyethylene (PE), PE foam, polyurethane (PU) foam, elastane, co-polymers or polymer blends including one or more these polymers. In one embodiment, first interior layers 414, 514 are ach comprised entirely of polyamide.

As shown in FIG. 12, for example, first side strap 420 and second side strap 520 may each include one or more interior layers disposed on a back surface of their respective frontal layer 440, 540. In one embodiment, one or more interior layers of first side strap 420 includes a first interior layer 424 and a second interior layer 426. In one embodiment, one or more interior layers of second side strap 520 includes a first interior layer 524 and a second interior layer 526. In various embodiments, first interior layers 424, 524 each comprise a first surface disposed against back surface of their respective frontal layers 440, 540. In various embodiments, second interior layers 426, 526 each comprise a front surface disposed against a back surface of their respective first interior layers 424, 524.

In various embodiments, first interior layers 424, 524 may each be a bonding film. In various embodiments, second interior layers 426, 526 may each be a be a woven, non-woven, or knitted polymeric layer adhered to their respective frontal layer 440, 540 via the bonding film of their respective first interior layer 424, 524. In various embodiments, second interior layers 426, 526 are each comprised of polymeric material, such as thermoplastic polyurethane (TPU), polyester, polyamide, polyethylene (PE), PE foam, polyurethane (PU) foam, elastane, co-polymers or polymer blends including one or more these polymers. In one embodiment, second interior layers 426, 526 each comprise the same material as their respective frontal layer 440, 540.

In some embodiments, as shown in FIG. 12, for example, first fastening member 422 may comprise a synthetic fabric strap 442 disposed against exterior surface of frontal surface 440, and second fastening member 522 may comprise a synthetic fabric strap 542 disposed against exterior surface of frontal layer 540. Fabric strips 442, 544 each comprise a plurality of macro-sized loops configured to fasten to a corresponding hook strap of a hook-and-loop fastener.

In various embodiments, any of the edges of cup portion 200, base portion 300, first strap portion 400, and second strap portion 500 may be reinforced by any suitable process, such as bonding, bonding, knitting, stitching, sowing, threading, weaving, or a combination thereof. In one embodiment, edges of cup portion 200, base portion 300, first strap portion 400, and second strap portion 500 are reinforced by bonding tape.

Figure 5:
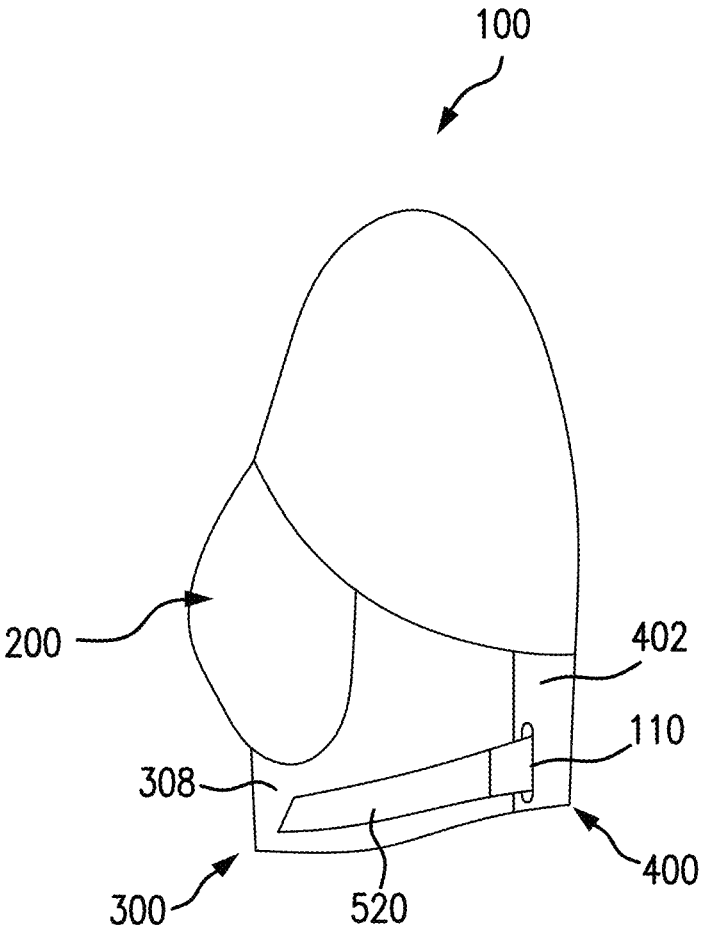
FIG. 5 shows a side view of a sports garment comprising first and second side straps set in a wrapped position according to embodiments.

Referring to FIGS. 3-5, sports garment 100 may further include a slot 110 configured to receive one of the first and second side straps 420, 520. In some embodiments, as shown in FIGS. 3-5, for example, slot 110 is disposed on first panel 402 of first strap portion 400, where slot 110 is proximate to first side edge 302 of base portion 300 and configured to receive second side strap 520. In some embodiments, slot 110 is disposed on second panel 502 of first strap portion 500, where slot 110 is proximate to second side edge 304 of base portion 300 and configured to receive first side strap 420. In some embodiments, slot 110 is disposed on base portion 300 between first fastening section 320 and first side edge 302, where slot 110 is configured to receive second side strap 520. In some embodiments, slot 110 is disposed on base portion 300 between second fastening section 322 and second side edge 304, where slot 110 is configured to receive first side strap 420.

Whether located on base portion 300, first side strap portion 400, or second side strap portion 500, slot 110 is disposed proximate to one of first and second side edges 302, 304 to receive a side strap extending from an opposite edge of the base portion 300. As shown in FIG. 4, by being disposed proximate to first side edge 302 and receiving side strap 520, slot 110 allows side strap 520 of second strap portion 500 to extend behind first back panel 402 of first strap portion 400, thereby allowing the first and second strap portions 400, 500 to overlap each other continuously along the back surface 312 of base portion 300. In some embodiments, slot 110 may be disposed proximate to second side edge 304 and configured to receive side strap 420, such that side strap 420 of first strap portion 400 extends behind second back panel 502 of second strap portion 500.

In some embodiments, slot 110 is spatially separated from one of first and second side edges 302, 304 by a predetermined distance in a range between 0.5-8 cm. In one embodiment, slot 110 is spatially separated from one of the first and second side edges 302, 304 by a predetermined distance of 0.5 cm.

In various embodiments, the location of slot 110 with respect to one of first and second edges 302, 304 of base portion 300 is selected to allow first and second strap portions 400, 500 to overlap each other continuously along the back surface 312 of base portion 300 when first and second side straps 420, 520 are set in the wrapped position. In the context of the present disclosure, the continuous overlap between the first and second strap portions 400, 500 along the back surface 312 of base portion 300 includes the base portion 300, first strap portion 400, and second strap portion 500 forming a complete, encircled band not interrupted by any void spaces. By overlapping each other continuously along the back surface 312 of base portion 300 while set in a wrapped configuration, first and second strap portions 400, 500 ensure that the sports garment 100 may be wrapped around the torso of the user with sufficient tension, thereby providing maximum support for the breasts of the user.

In some embodiments, as shown in FIGS. 3-5, for example, slot 110 extends parallel with respect to one of first and second side edges 302, 304 of base portion 300. In some embodiments, slot 110 may extend in any direction suitable for receiving one of first and second side straps 420, 520. In some embodiments, slot 110 may have a height in a range between 1-10 cm. In one embodiment, slot 110 has a height of 3.8 cm.

In various embodiments, the contour of slot 110 may be reinforced with one or more layers of material suitable for maintaining the integrity of the slot 110. In some embodiments, the one or more layers may comprise a polymeric material, such as polyamide, elastane, polyester, polyethylene (PE), and co-polymers or polymer blends including one or more these polymers. In some embodiments, the one or more layers may be joined along the contour of slot 110 by any suitable process, such as adhesive bonding, knitting, stitching, sowing, threading, weaving, or a combination thereof.

FIGS. 13-17 illustrate a sports garment 1000 according to one embodiment of the present disclosure. Similar to the embodiment shown in FIGS. 1-6, sports garment 1000 includes a cup portion 1200, a base portion 1300, a first strap portion 1400, and a second strap portion 1500 that may include all the same or similar features of the embodiments described above.

Figure 13:
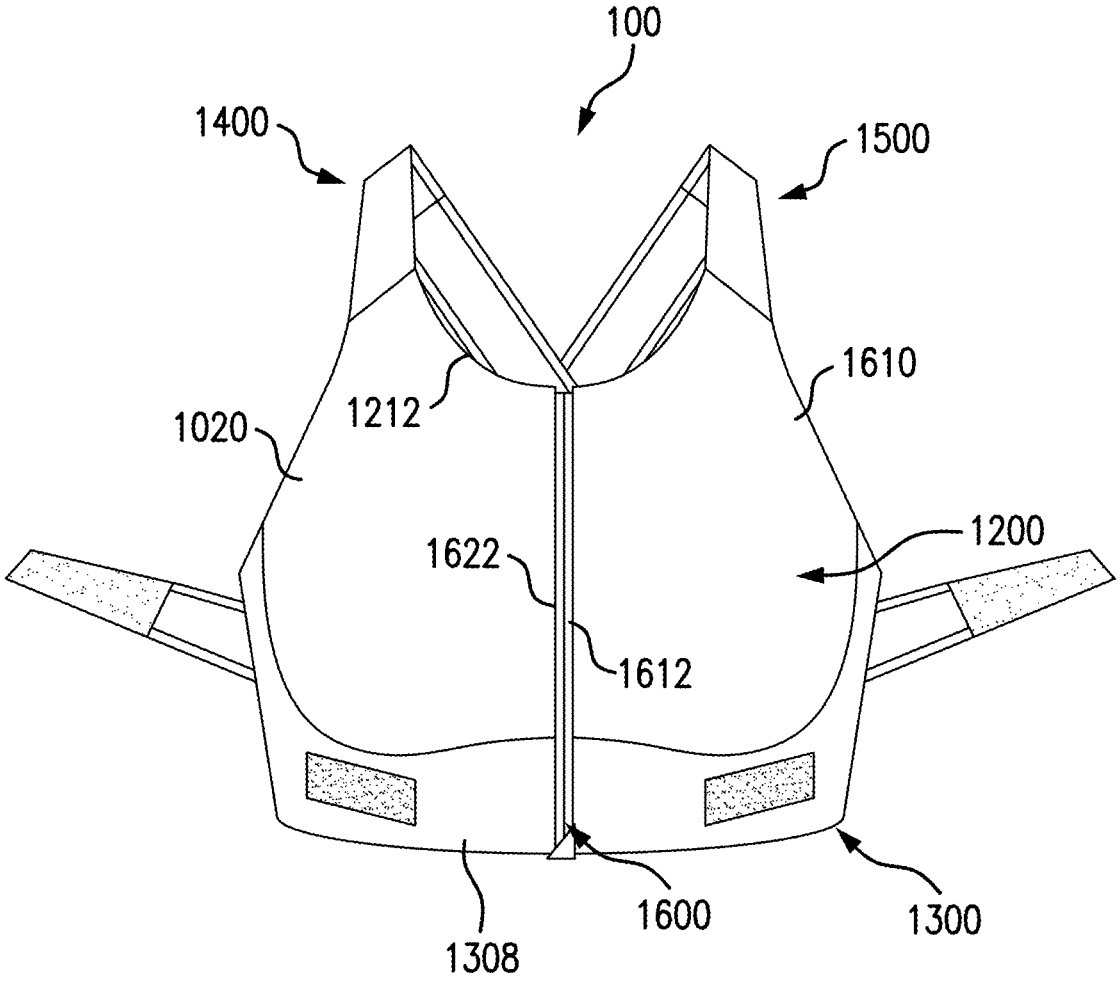
FIG. 13 shows a front view of a sports garment comprising first and second side straps set in an open position according to embodiments.
Figure 14:
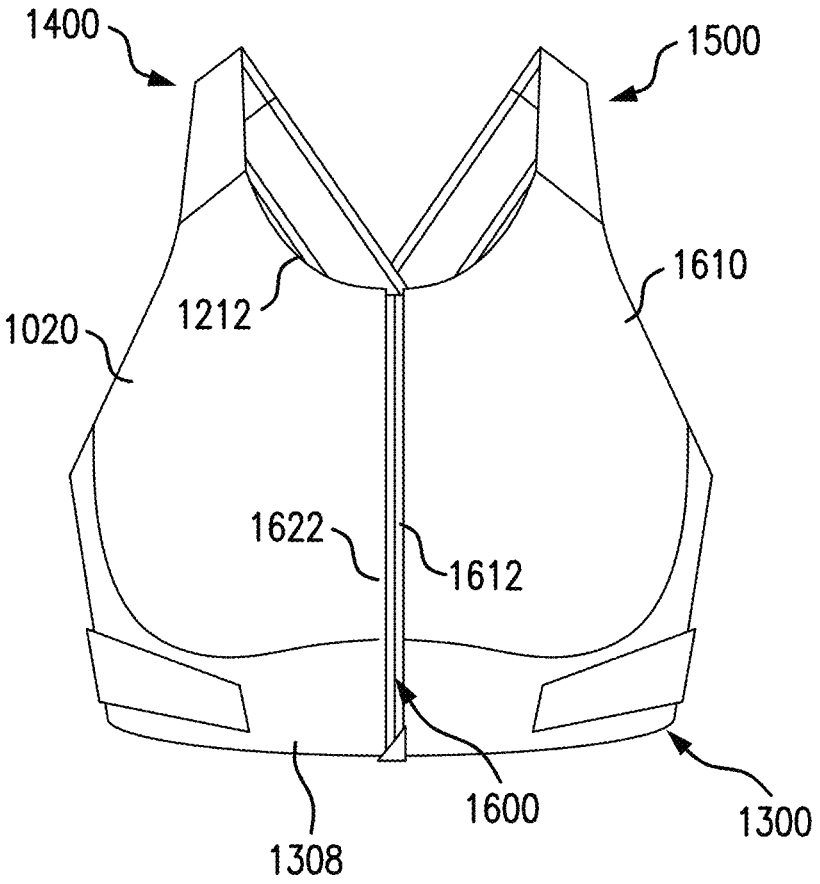
FIG. 14 shows a front view of a sports garment comprising first and second side straps set in a wrapped position according to embodiments.
Figure 15:
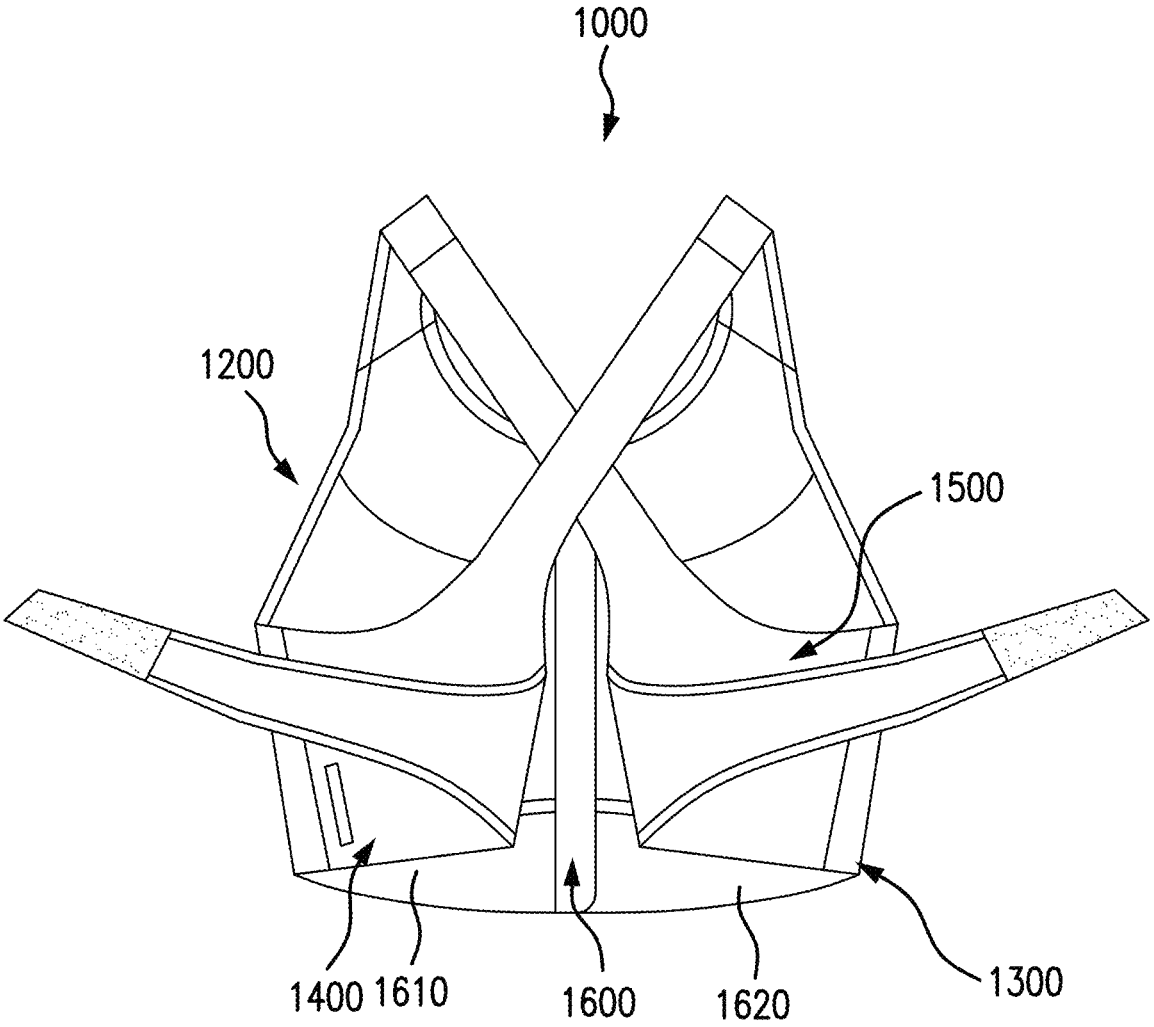
FIG. 15 shows a back view of a sports garment comprising first and second side straps set in an open position according to embodiment.
Figure 16:
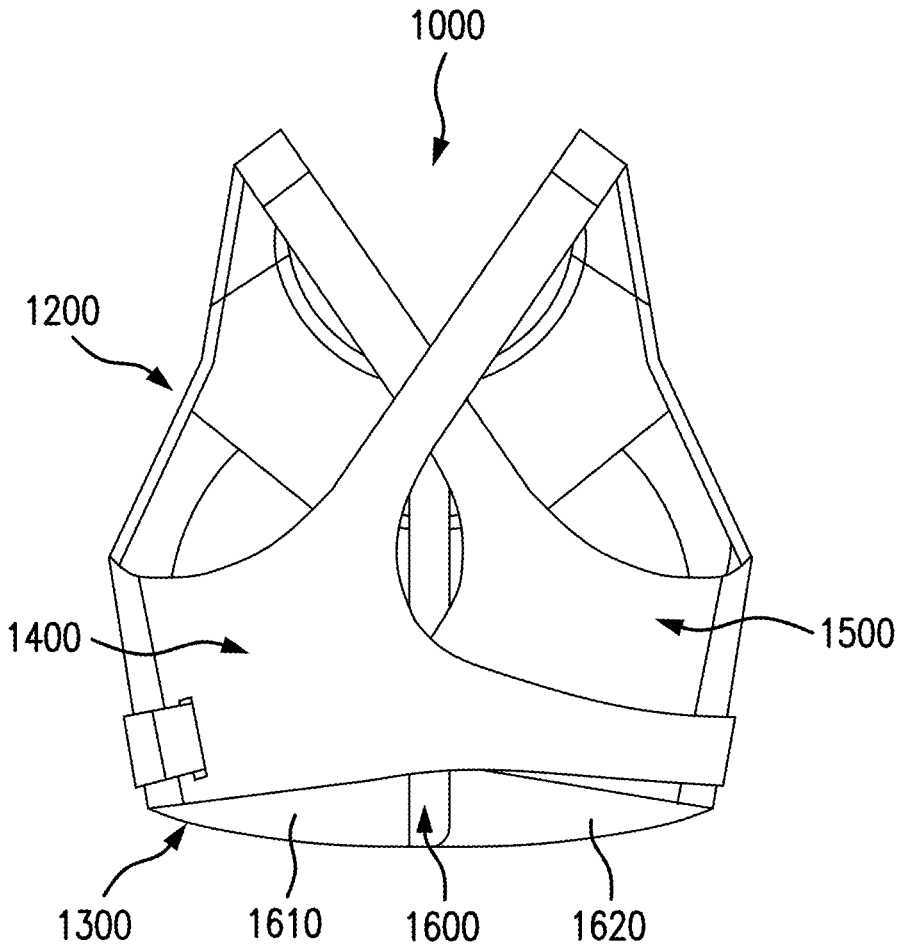
FIG. 16 shows a back view of a sports garment comprising first and second side straps set in a wrapped position according to embodiments.
Figure 17:
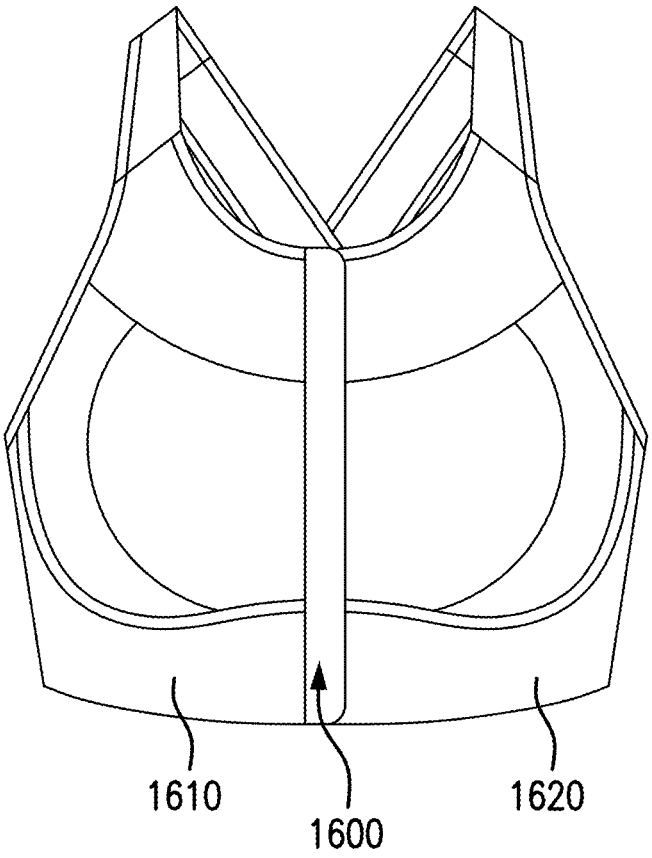
FIG. 17 shows a back view of a sports garment with first and second strap portions removed according to embodiment.

As shown in FIGS. 13 and 14, for example, cup portion 1200 may extend higher in the vertical direction along the chest of the user, and sports garment 1000 may further includes a coupling unit 1600 extending along cup portion 1200 and base portion 1300 in a vertical direction, bifurcating cup portion 1200 and base portion 1300 into a first segment 1610 and a second segment 1620 that are removably coupled together.

In some embodiments, first segment 1610 includes first strap portion 1400 and a first half segment of cup portion 200 and base portion 300, and second segment 1620 includes second strap portion 1500 and a second half segment of cup portion 200 and base portion 300. First segment 1610 includes a mating edge 1612 extending from neckline edge 1212 of cup portion to bottom edge 1308 of base portion 300. Second segment 1620 includes a mating edge 1622 extending from neckline edge 1212 of cup portion 200 to bottom edge 1308 of base portion 1300.

In one embodiment, coupling unit 1600 comprises a zipper member and a pair of zipper lines disposed on mating edges 1612, 1622 of first and second segments 1610, 1622 to removably couple first and second segments 1610, 1620 together. In some embodiments, coupling unit 1600 may comprise other types of fasteners suitable for removably coupling first and second segments 1610, 1620.

Figure 18:
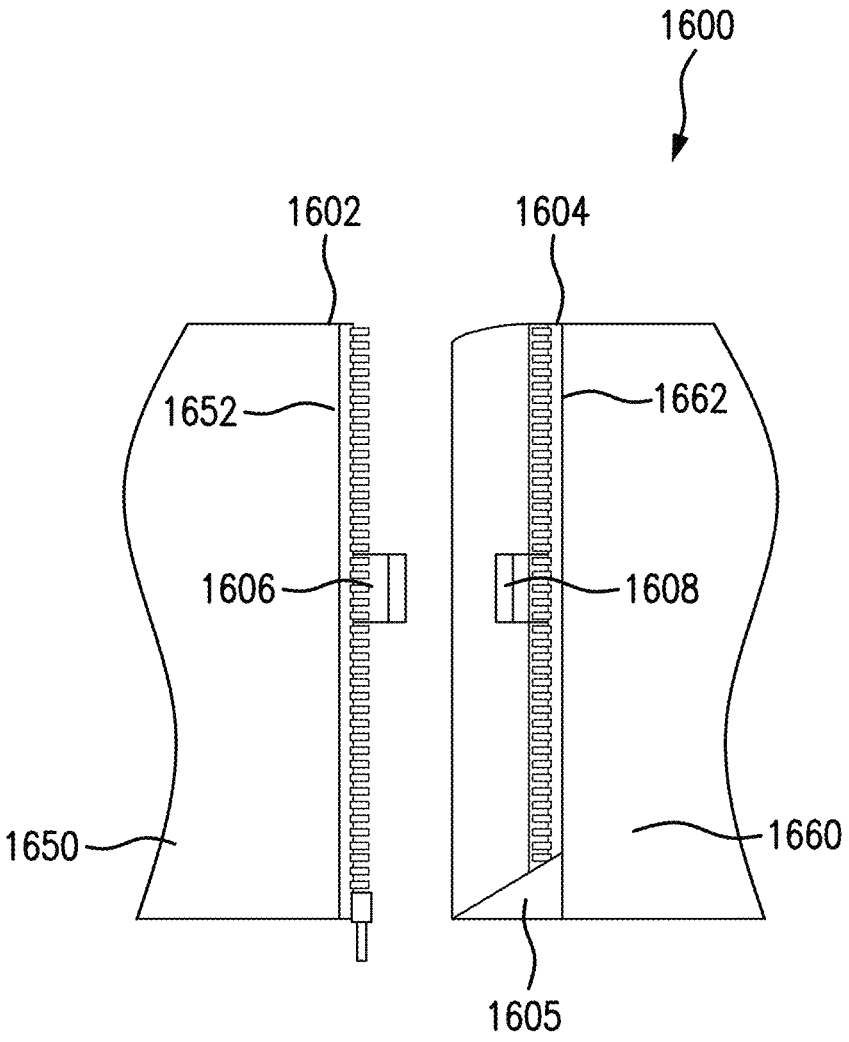
FIG. 18 shows a detailed view of a coupling unit for coupling first and second segments of a sports bra according to embodiments.

FIG. 18 illustrates a detailed view of coupling unit 1600 according one embodiment of the present disclosure. In some embodiments, coupling unit 1600 may include a first zipper line 1602 disposed along a first mating edge 1652 of a first segment 1650 and a second zipper line 1604 disposed along a second mating edge 1662 of a second segment 1660 and configured to mate with first zipper line 1602. Coupling unit 1600 may include a zipper member 1606 coupled to first zipper line 1602 and configured to couple second zipper line 1604 with a first zipper line 1602 so that the first and second mating edges 1652, 1662 are coupled together and extend contiguously with each other.

In some embodiments, coupling 1600 may further include a zipper flap 1605 extending from second mating edge 1662 of second segment 1660, a loop 1608 connected to the first mating edge 1652 of the first segment 1650, and a hook 1610 connected to the second mating edge 1662 of second segment 1660 and configured to be removably coupled to the loop 1608.

Figure 19A:
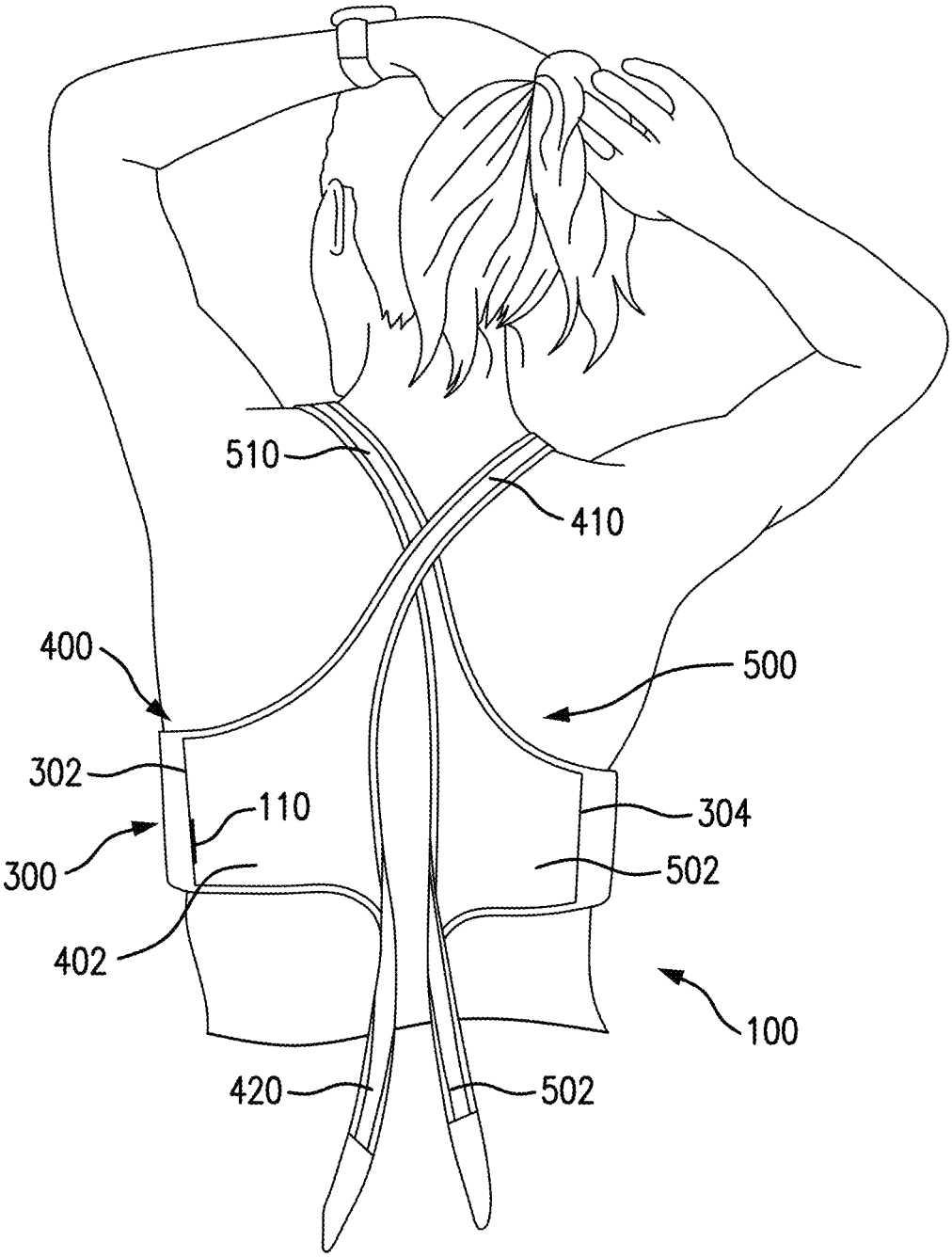
FIG. 19A shows a state in a method for securing a sports garment to a user, in which a sports garment is received on the shoulders of the user and partially wrapped around the torso of the user, according to embodiments.
Figure 19B:
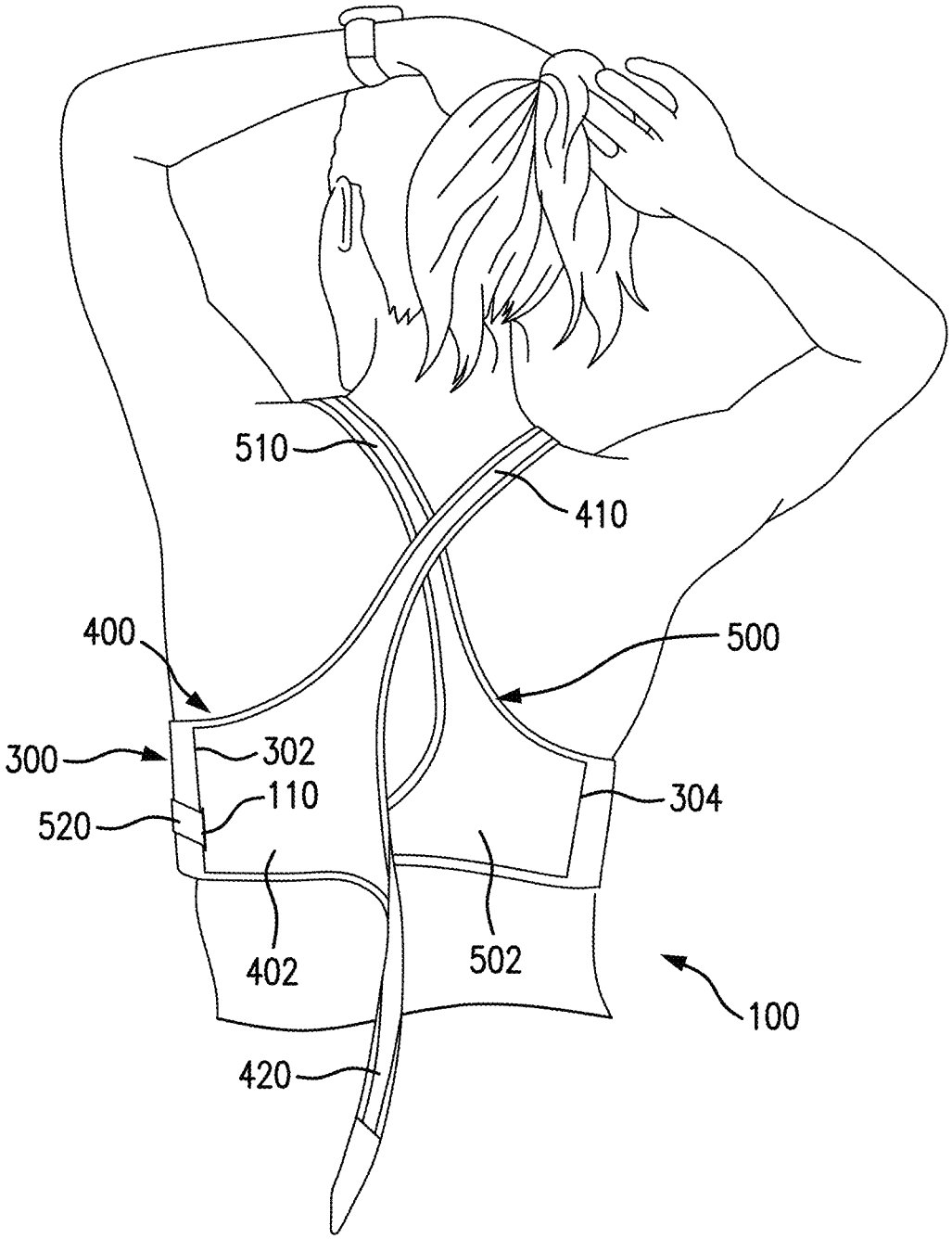
FIG. 19B shows a state in a method of securing a sports garment to a user, in which a second side strap is secured to a front surface of a base portion of a sports garment, according to embodiments.
Figure 19C:
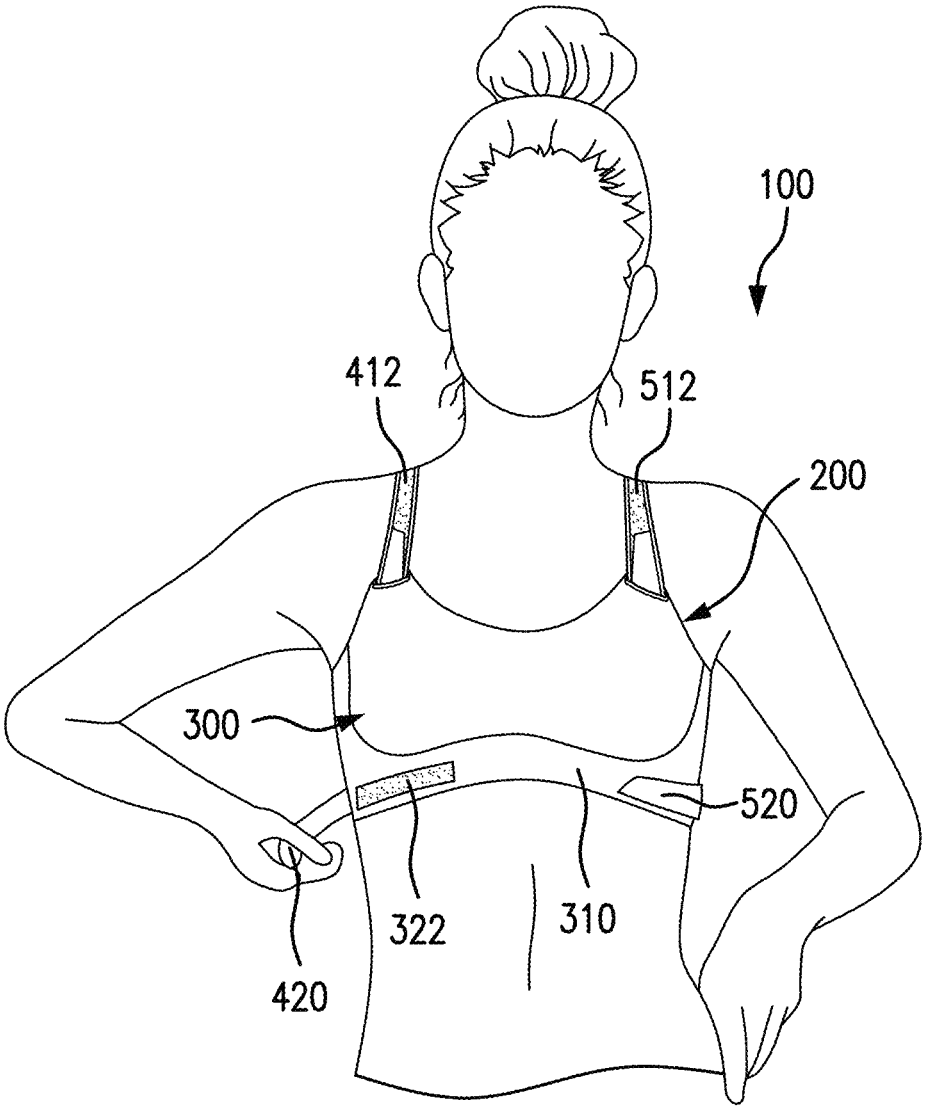
FIG. 19C shows a state in a method of securing a sports garment to a user, in which a user is coupling a first side strap to a front surface of a base portion of a sports garment, according to embodiments.
Figure 19D:
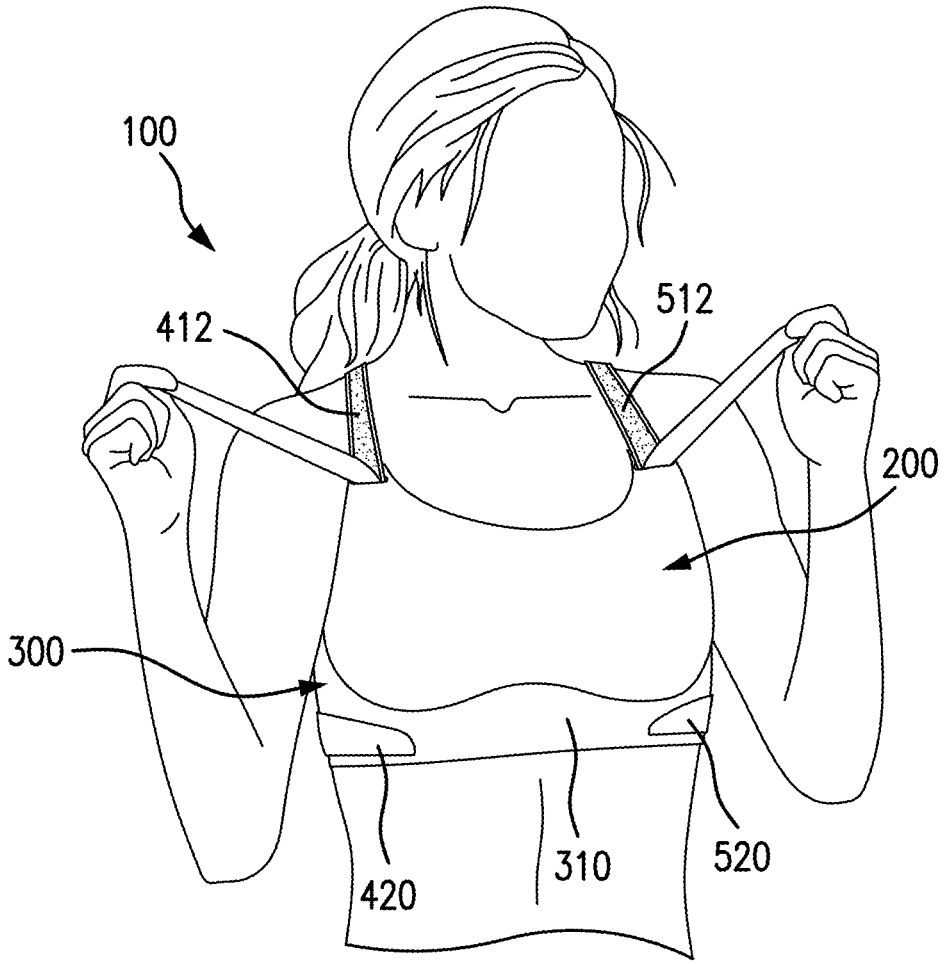
FIG. 19D shows a state in a method of securing a sports garment to a user, in which a user is adjusting the tension and fit of sports garment, according to embodiments.
Figure 20:
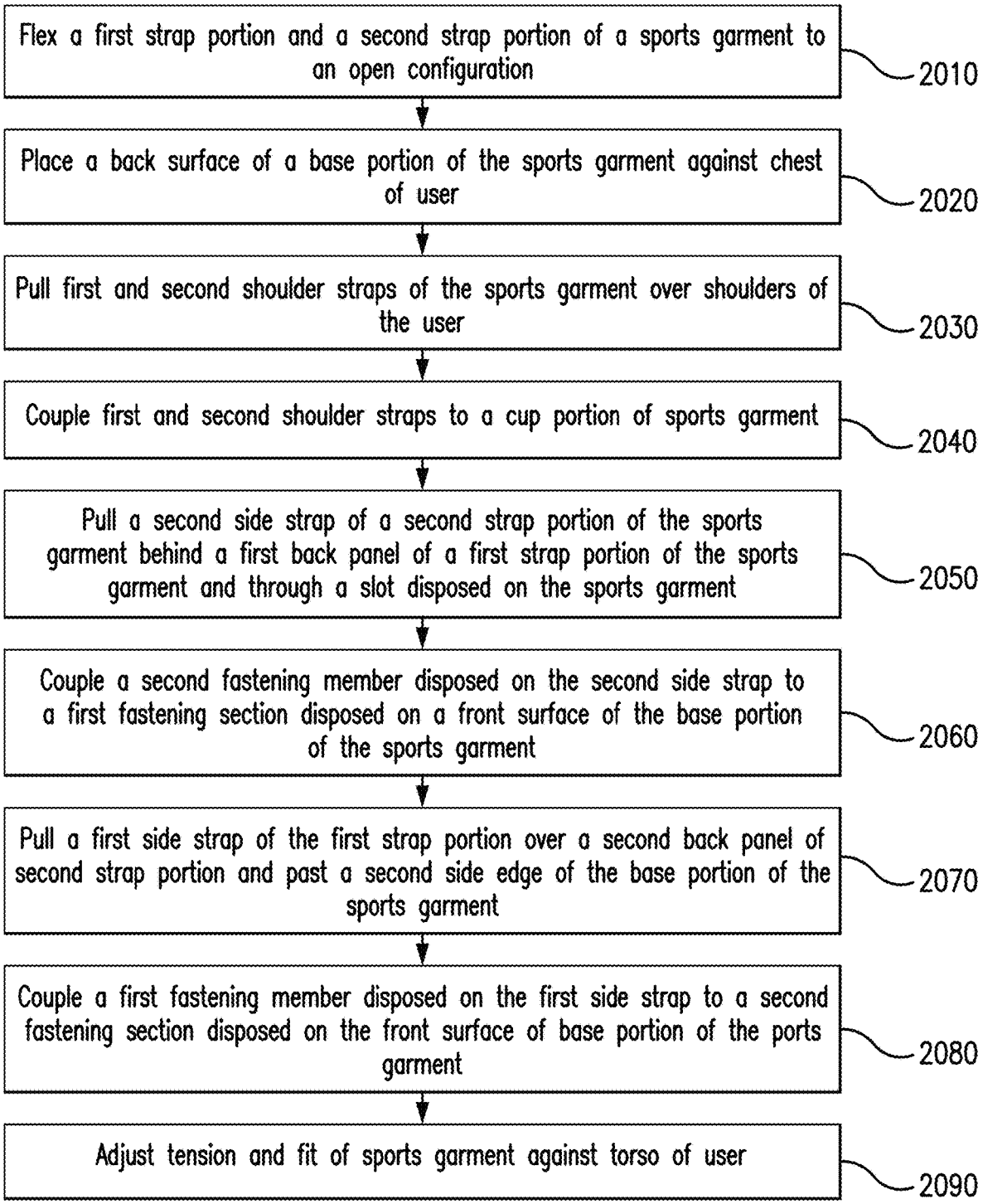
FIG. 20 shows a flow chart of a method for securing a sports garment to a user according to embodiments.

FIGS. 19A-D illustrate a sequence of steps for securing the sports garment 100 to a user, and FIG. 20 show a flow chart of an exemplary method 2000 for securing the sports garment 100 to a user.

In various embodiments, method 2000 may include a step 2010 of flexing first strap portion 400 and second strap portion 500 to an open configuration, wherein first and second strap portions 400, 500 do not extend across the back surface 312 of base portion 300 such that the back surface 312 of base portion 300 is exposed to receive the torso of the user. Step 2010 may include pivoting first and second back panels 402, 502 away from back surface 312 of base portion 300. Step 2010 may include flexing or pulling first and second side straps 420, 520 to an open position, as shown in FIG. 3.

In various embodiments, method 2000 may include a step 2020 of placing back surface 312 of base portion 300 against the chest of user. Step 2020 may include placing cup portion 200 over the breasts of user and flexing first and second arm edges 208, 210 of cup portion 200 outward so that cup portion 200 covers the breasts of the user.

In various embodiments, method 2000 may include a step 2030 of pulling first and second shoulder straps 410, 510 over the shoulders of user, such that first and second shoulder straps 410, 510 cross each other along a back of the user. Step 2030 may include pulling first shoulder strap 410 toward second shoulder edge 206 of cup portion 200 and pulling second shoulder strap 510 toward first shoulder edge 204 of cup portion 200

In various embodiments, method 2000 may include a step 2040 of coupling first and second shoulder straps 410, 510 to cup portion 200. Step 2040 may include passing first shoulder strap 410 through slot 207 proximate to second shoulder edge 206, and subsequently, attaching the loop strap to the hook strap of fastener 412 so that first shoulder strap 410 is secured to cup portion 200. Step 2040 may include passing second shoulder strap 510 through slot 205 proximate to first shoulder edge 204, and subsequently, attaching the loop strap to the hook strap of fastener 512 so that the second shoulder strap 510 is secured to cup portion 200.

FIG. 19A illustrates a state in method 2000 after the completion of steps 2010-2040, in which sports garment 100 is received on the shoulders of the user and partially wrapped around the torso of the user. As shown in FIG. 19A, for example, first shoulder strap 410 crosses second shoulder strap 510 along the back of user, and first and second shoulder straps 410, 510 hang over the shoulders of the user and are coupled to cup portion 200.

In various embodiments, method 2000 may include a step 2050 of pulling second side strap 520 of second strap portion 500 behind first back panel 402 of first strap portion 400 and through slot 110, such that distal end 521 of second side strap 520 extends past first side edge 302 of base portion 300. Step 2050 may further include pulling first side strap 420 away from the back of user to allow second side strap 520 easily slip behind first back panel 402.

In various embodiments, method 2000 may include a step 2060 of coupling second fastening member 522 disposed on second side strap 520 to first fastening section 320 disposed on front surface 310 of base portion 300. Step 2060 may include adjusting the tension of second side strap 520 by repositioning second fastening member 522 along first fastening section 320 of base portion 300.

FIG. 19B illustrates a state in method 2000 after the completion of steps 2010-2060, in which second side strap 520 is secured to front surface 310 of base portion 300. As shown in FIG. 19B, for example, second side strap 520 extends behind first back panel 402 of first strap portion 400 and is received through slot 110.

In various embodiments, method 2000 may include a step 2070 of pulling first side strap 420 of first strap portion 400 over second back panel 502 of second strap portion 500 and past second side edge 304 of base portion 300.

In various embodiments, method 2000 may include a step 2080 of coupling first fastening member 422 disposed on first side strap 420 to second fastening section 322 disposed on front surface 310 of base portion 300. Step 2080 may include adjusting the tension of second side strap 520 by repositioning second fastening member 522 along first fastening section 320 of base portion 300.

FIG. 19C illustrates a state in method 2000 during the process of step 2080, in which the user is coupling first side strap 420 to front surface 310 of base portion 300. As shown in FIG. 19C, for example, distal end 421 of first side strap 420 extends beyond first side edge 302 of base portion 300 such that first fastening member 422 is proximate to second fastening section 322 of base portion 300.

In various embodiments, method 2000 may include a step 2090 of adjusting tension and fit of sports garment 100 against the torso of the user. Step 2090 may include modifying the length of first and second shoulder straps 410, 510 to increase or reduce the tension of first and second shoulder straps 410, 510. Step 2090 may include reducing the length of first and second shoulder straps 410, 510 to provide further lift to the breasts of the user. Step 2090 may include modifying the positioning of the first and second fastening members 422, 522 on first and second fastening sections 320, 322 to adjust the tension of first and second side straps 420, 520.

FIG. 19D illustrates a state in method 2000 during the process of step 2090, in which the user is adjusting the tension and fit of sports garment 100. As shown in FIG. 19D, for example, the length of shoulder straps 410, 510 may be modified by repositioning the loop strap on the hook strap of fasteners 412, 512. Shortening the length of shoulder straps 410, 510 provide more lift against the breasts of user, thereby maximizing support of the breasts.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A sports bra comprising:

a cup portion configured to receive and conform to breasts of a user;

a base portion disposed along a bottom edge of the cup portion and configured to stretch along a torso of the user to support the cup portion, the base portion comprising an outer surface and an inner surface;

a first strap portion disposed along a left side edge of the base portion, the first strap portion comprising a first back panel extending from the left side edge of the base portion, a first shoulder strap extending from the first back panel, and a first side strap extending from the first back panel, wherein the first side strap is configured to be removably fastened to a right side of the outer surface of the base portion to adjust tension of the sports bra;

a second strap portion disposed along a right side edge of the base portion, the second strap portion comprising a second back panel extending from the right side edge of the base portion, a second shoulder strap extending from the second back panel, and a second side strap extending from the second back panel, wherein the second side strap is configured to be removably fastened to a left side of the outer surface of the base portion to adjust tension of the sports bra; and a slot disposed on the sports bra and configured to receive one of the first and second side straps, wherein the first and second side straps are configured to flex between an open position and a wrapped position, wherein when the first and second side straps are set in the wrapped position, the base portion, the first strap portion, and the second strap portion collectively form an encircled band configured to wrap around the torso of the user, and one of the first and second side straps is received through the slot such that first and second strap portions are configured to overlap each other along a back of the user, wherein when the first and second side straps are set in the open position, neither one of the first and second strap portions is received through the slot, wherein the first and second shoulder straps are configured to hang over shoulders of the user, the first shoulder strap is configured to be removably coupled to a right side of the cup portion and the second shoulder strap is configured to be removably coupled to a left side of the cup portion to adjust tension of the sports garment, and when the first and second shoulder straps are removably coupled to the cup portion, the first shoulder strap is configured to intersect the second shoulder strap along the back of the user.

2. The sports bra of claim 1, wherein the base portion comprises a first fastening section disposed on the left side of the outer surface of the base portion and a second fastening section disposed on the right side of the outer surface of the base portion and spatially separated from the first fastening section, and wherein the first strap portion comprises a first fastening member disposed on the first side strap and configured to be removably fastened to the second fastening section of the base portion, and the second strap portion comprises a second fastening member disposed on the second side strap and configured to be removably fastened to the first fastening section of the base.

3. The sports bra of claim 2, wherein the first and second fastening members and the first and second fastening sections are hook-and-loop fasteners.

4. The sports bra of claim 2, wherein the slot is disposed on the first back panel of the first strap portion or the second back panel of the second strap portion.

5. The sports bra of claim 1, wherein the cup portion comprises a first frontal seamless layer comprised of an elastic material, the base portion comprises a second frontal seamless layer comprised of an elastic material, the first strap portion comprises a third frontal seamless layer comprised of an elastic material, and the second strap portion comprises a fourth frontal seamless layer comprised of an elastic material.

6. The sports bra of claim 5, wherein the cup portion comprises a first interior layer comprised of a mesh material and a second interior layer comprised of a rigid material, and wherein the cup portion comprises a cup section, a central section and a side section spaced apart from the central section by the cup section, and the second interior layer is disposed on the central section and side section.

7. The sports bra of claim 1, wherein the first side strap and the first shoulder strap merge at a first intersection edge of the first back panel;

wherein the second side strap and the second shoulder strap merge at a second intersection edge of the second back panel.

8. The sports bra of claim 7, wherein when the first and second side straps are set in the wrapped position and the first and second shoulder straps are removably coupled to the cup portion, at least a portion of the first intersection edge of the first back panel is spatially separated from a portion of the second intersection edge of the second back panel along the back of the user.

9. A sports garment comprising:

a cup portion configured to receive and conform to breasts of a user;

a base portion disposed along a bottom edge of the cup portion and configured to stretch along a torso of the user to support the cup portion, the base portion comprising an outer surface, an inner surface, a first fastening section disposed on a left side of the outer surface of the base portion, and a second fastening section disposed on a right side of the outer surface of the base portion and spatially separated from the first fastening section;

a first strap portion disposed along a left side edge of the base portion, the first strap portion comprising a first back panel extending from the left side edge of the base portion, a first shoulder strap extending from the first back panel, a first side strap extending from the first back panel, and a first fastening member disposed on the first side strap and configured to be removably fastened to the second fastening section to adjust tension of the sports garment; and a second strap portion disposed along a right side edge of the base portion, the second strap portion comprising a second back panel extending from the right side edge of the base portion, a second shoulder strap extending from the second back panel, a second side strap extending from the second back panel, and a second fastening member disposed on the second side strap and configured to be removably fastened to the first fastening section to adjust tension of the sports garment, wherein the first and second side straps are configured to flex between an open position and a wrapped position, wherein when the first and second side straps are set in the wrapped position, the first fastening member is fastened to the second fastening section of the base portion and the second fastening member is fastened to the first fastening section of the base portion such that the base portion, the first strap portion, and the second strap portion collectively form an encircled band configured to wrap around the torso of the user, wherein when the first and second side straps are set in the open position, the first fastening member is unfastened from the second fastening section of the base portion and the second fastening member is unfastened from the first fastening section of the base portion, wherein the first and second shoulder straps are configured to hang over shoulders of the user, the first shoulder strap is configured to be removably coupled to a right side of the cup portion and the second shoulder strap is configured to be removably coupled to a left side of the cup portion to adjust tension of the sports garment, and when the first and second shoulder straps are removably coupled to the cup portion, the first shoulder strap is configured to intersect the second shoulder strap along the back of the user.

10. The sports garment of claim 9, further comprising a slot for receiving one of the first and second side straps and disposed on the first back panel of the first strap portion or the second back panel of the second strap portion, and wherein the first and second side straps are set in the wrapped position, one of the first and second side straps is received through the slot.

11. The sports garment of claim 9, wherein the cup portion comprises a first seamless frontal layer comprised of an elastic material and the base portion comprises a second seamless frontal layer comprised of an elastic material.

12. The sports garment of claim 11, wherein the first and second seamless frontal layers of the cup portion and the base portion extend contiguously with each other.

13. The sports garment of claim 11, wherein the cup portion comprises a first interior layer comprised of a mesh material and a second interior layer comprised of a rigid material.

14. The sports garment of claim 13, wherein the cup portion comprises a first cup section, a second cup section, a center section disposed between the first and second cup sections, a first side section disposed between the first cup section and a first arm edge of the cup portion, and a second side section disposed between the second cup section and a second arm edge of the cup portion, wherein the first interior layer is disposed along the first and second cup sections of the cup portion, and the second interior layer is disposed along the first and second side sections and the center section of the cup portion.

15. The sports garment of claim 9, wherein the first side strap and the first shoulder strap merge at a first intersection edge of the first back panel, wherein the second side strap and the second shoulder strap merge at a second intersection edge of the second back panel.

16. The sports garment of claim 15, wherein when the first and second side straps are set in the wrapped position and the first and second shoulder straps are removably coupled to the cup portion, at least a portion of the first intersection edge of the first back panel is spatially separated from a portion of the second intersection edge of the second back panel along the back of the user.

17. The sports garment of claim 9, wherein the first and second fastening members and the first and second fastening sections are hook-and-loop fasteners.

18. A sports garment comprising:

a cup portion configured to receive and conform to breasts of a user;

a base portion disposed along a bottom edge of the cup portion and configured to stretch along a torso of the user to support the cup portion, the base portion comprising an outer surface and an inner surface;

a first strap portion disposed along a left side edge of the base portion, the first strap portion comprising a first shoulder strap and a first side strap configured to be removably fastened to a right side of the outer surface of the base portion to adjust tension of the sports bra; and a second strap portion disposed along a right side edge of the base portion, the second strap portion comprising a second shoulder strap and a second side strap configured to be removably fastened to a left side of the outer surface of the base portion to adjust tension of the sports bra, wherein the first and second shoulder straps are configured to hang over the shoulders, the first shoulder strap configured to be removably coupled to a right side of the cup portion, the second shoulder strap configured to be removably coupled to a left side of the cup portion to adjust tension of the sports garment, wherein the first and second side straps are configured to flex between an open position and a wrapped position, wherein when the first and second side straps are set in the wrapped position, the first and second side straps are fastened to the outer surface of the base portion such that the base portion, the first strap portion, and the second strap portion collectively form an encircled band configured to wrap around the torso of the user, wherein when the first and second side straps are set in the open position, the first side strap is unfastened from the outer surface of the base portion and the second side strap is unfastened from the outer surface of the base portion, wherein the cup portion comprises a first seamless frontal layer comprised of an elastic material, the base portion comprises a second seamless frontal layer comprised of an elastic material, the first strap portion comprises a third seamless frontal layer comprised of an elastic material that extends along the first side strap and the first shoulder strap, and the second strap portion comprises a fourth seamless frontal layer comprised of an elastic material that extends along the second side strap and the second shoulder strap.

19. The sports garment of claim 18, wherein the cup portion comprises an interior layer comprised of a rigid material.

20. The sports garment of claim 18, further comprising:

a slot disposed on the sports garment and configured to receive one of the first and second side straps, wherein the first and second side straps are set in the wrapped position, one of the first and second side straps is received through the slot.

* * * * *